US005585893A

United States Patent [19]

Fujita et al.

[11] Patent Number: 5,585,893

[45] Date of Patent: Dec. 17, 1996

[54] IMAGE FORMING APPARATUS

[75] Inventors: Hirokazu Fujita, Nara; Yoshinobu Okumura, Yamatokoriyama; Hirokazu Tanaka, Osaka, all of Japan

[73] Assignee: Sharp Kabushiki Kaisha, Osaka, Japan

[21] Appl. No.: 433,860

[22] Filed: May 2, 1995

[30] Foreign Application Priority Data

Jun. 22, 1994 [JP] Japan ..... 6-140102

[51] Int. Cl.[6] ..... G03G 15/00

[52] U.S. Cl. ..... 355/210; 355/200; 355/211; 355/228; 355/229; 347/138; 347/152

[58] Field of Search ..... 355/200, 210, 355/211, 228, 229; 358/300; 347/129, 138, 152

[56] References Cited

U.S. PATENT DOCUMENTS

| | | | |
|---|---|---|---|
| 4,253,758 | 3/1981 | Cormier | 355/200 |
| 4,708,455 | 11/1987 | Kubota et al. | 355/211 |
| 4,743,926 | 5/1988 | Schmidlin et al. . | |
| 4,888,620 | 12/1989 | Fujino et al. | 355/211 |
| 4,943,828 | 7/1990 | Manabe et al. | 355/200 |
| 5,172,163 | 12/1992 | Yamaoki et al. | 355/210 |
| 5,214,451 | 5/1993 | Schmidlin et al. . | |
| 5,374,978 | 12/1994 | Asanae et al. | 355/210 |
| 5,483,272 | 1/1996 | Mukataka et al. | 347/129 |
| 5,532,796 | 7/1996 | Narikawa et al. | 355/210 |

FOREIGN PATENT DOCUMENTS

| | | |
|---|---|---|
| 0463743A3 | 1/1992 | European Pat. Off. . |
| 0550880A2 | 7/1993 | European Pat. Off. . |
| 0617335A2 | 9/1994 | European Pat. Off. . |
| 2-4900 | 1/1990 | Japan . |
| 2-188768 | 7/1990 | Japan . |
| 4-130390 | 5/1992 | Japan . |

*Primary Examiner*—Matthew S. Smith
*Attorney, Agent, or Firm*—David G. Conlin; Milton Oliver

[57] ABSTRACT

An image forming apparatus in accordance with the present invention is provided with a unit composed of members such as a photoreceptor drum and an optical system, the unit being attachably and detachably provided with respect to the image forming apparatus main body. With the arrangement, the replacement of the photoreceptor drum can be made at the user's end with ease. It is not necessary to carry out fine adjustments at the user's end for positioning the photoreceptor drum and optical system with respect to the image forming apparatus main body. Thus, professional skill is not required for the replacement of the photoreceptor drum, thereby resulting in that the operations such as maintenance can be effectively made. It is preferable that a cleaner is further provided for removing any contaminated materials adhering to the inner surface of the photoreceptor drum. With the cleaner, the contaminated materials can be removed from the inner surface of the photoreceptor drum, thereby avoiding that the exposure of the photoreceptor drum is not appropriately carried out.

28 Claims, 34 Drawing Sheets

IMAGE FORMING APPARATUS

FIELD OF THE INVENTION

The present invention relates to a so-called rear exposure type image forming apparatus in which an exposure is carried out on the inner surface side of a photoreceptor on which a transparent conductive layer and a photoconductive layer are luminated in this order on the outer surface of a substrate that is made of transparent material and is of a cylindrical shape.

BACKGROUND OF THE INVENTION

Recently, according to the development of office automation, an image forming apparatus has come into wide use as an output device. The user has demanded much higher image quality and much faster response. The user has also demanded a low cost and compact image forming apparatus. In order to meet the foregoing demands, the improvement of an image forming apparatus, which adopts an electrophotographic process, i.e., the Carlson process, has been done.

The image forming apparatus with the Carlson process, as illustrated in FIG. 34, is arranged such that a charger 102, an exposure unit 103, a developer 104, a transfer unit 105, a fuser 106, a cleaner 107, and an eraser 108 are provided in this order around a photoreceptor drum 101 on which a photosensitive layer is provided. The image forming apparatus has adopted a so-called positive developer method.

With the arrangement, the surface of the photoreceptor drum 101 is first uniformly charged by the charger 102 in a dark place. Next, the light corresponding to an image pattern signal of such as an original document is projected onto the surface of the photoreceptor drum 101 by the exposure unit 103. This results in that the charged electrostatic charges are removed from the projected portion so as to form an electrostatic latent image. Then, a toner 109, which is stored in the developer 104 and charged so as to have polarity opposite to the charged electrostatic charges on the surface of the photoreceptor drum 101, adheres to the electrostatic latent image, thereby forming a toner image.

Then, a copy paper 110 and the toner image are overlapped with each other, and the Corona discharge is carried out on the rear side of the copy paper 110 by the transfer unit 105 so as to have polarity of electrostatic charges opposite to that of the toner 109, thereby transferring the toner image to the copy paper 110. The transferred toner image is fused on the copy paper 110 by the fuser 106 while heating and pressing. In contrast, the residual toners 109*a*, adhered to the surface of the photoreceptor drum 101, which has not been transferred to the copy paper 110 are removed by the cleaner 107. The electrostatic latent image on the photoreceptor drum 101 is erased upon receipt of light projection from the eraser 108. Then, the foregoing process starting from the charging by the charger 102 is repeated, thereby carrying out the continuous image forming. In general, in the image forming apparatus with use of the positive developer method, the Corona discharger is used during the charging of the photoreceptor drum 101 and during the transferring of the toner image to the copy paper 110.

However, in the corona discharger, it is required that the high voltage of a several thousands of kilo volts be applied. Further, there is the change in the charged amount on the surface of the photoreceptor drum 101 due to the temperature changes for instance, i.e., the corona discharger is likely to be affected by the environmental changes. Since there generates ozone during the Corona discharging, thereby presenting the problem on the environmental sanitation. In the image forming apparatus with use of the positive developer method, there is provided each constituting members such as the charger 102, the exposure unit 103 and the cleaner 107 around the photoreceptor 101, while there is provided nothing in the photoreceptor 101, thereby making it difficult to further reduce the size of the image forming apparatus.

In order to solve the foregoing problem of the image forming apparatus of positive developer method, there are proposed so-called rear exposure type image forming apparatuses in which an exposure is carried out on the inner surface side of a photoreceptor (see, for example, the Japanese examined patent publication No. 2-4900, the Japanese unexamined patent publication Nos. 2-188768 and 4-130390).

The rear exposure type image forming apparatuses have an exposure unit and other units on the inner surface side of the photoreceptor drum, thereby realizing further compactness. The rear exposure type image forming apparatuses neither necessitate a charger for charging a photosensitive layer of the surface of the photoreceptor drum nor a cleaner for removing the residual toners on the photoreceptor drum, thereby resulting in that the deterioration and abrasion of the photoreceptor drum less occurs than the image forming apparatus with use of the positive developer method. Accordingly, the life time of the photoreceptor drum can be prolonged.

However, the life time of the photoreceptor drum is shorter than that of the main body of the image forming apparatus, though the deterioration and abrasion are hard to occur. Therefore, it is necessary to appropriately replace the photoreceptor (consumable goods) in accordance with the use frequency of the image forming apparatus. But, the replacement of the photoreceptor needs much professional skill since the constituent units such as the exposure unit of the foregoing conventional image forming apparatus is provided on the inner surface side of the photoreceptor drum. Namely, in the conventional image forming apparatus, it is impossible to replace an old photoreceptor drum with a new one at the user's end, thereby presenting a problem that the work efficiency during procedures such as maintenance is lowered.

Further, when the toner, dispersed from the units such as the developer, comes into on the inner surface side of the photoreceptor drum, the exposure can not be carried out in a good condition accordingly. Therefore, it is hard to remove the dispersed toner since the members such as the exposure unit of the foregoing conventional image forming apparatus is provided on the inner surface side of the photoreceptor drum.

SUMMARY OF THE INVENTION

The present invention is made in the light of the foregoing problems, and its object is to provide an image forming apparatus in which the replacement of a photoreceptor can be made at the user's end without the professional skill.

In order to achieve the foregoing object, an image forming apparatus of the present invention is provided with:

an image forming apparatus main body;

a photoreceptor, rotatably provided in a unit, which is made of a transparent material and has a cylindrical shape; and exposure means, provided on the inner surface side of the photoreceptor, for exposing the photoreceptor, wherein the unit is attachable and detachable with respect to the image forming apparatus main body.

With the arrangement, the photoreceptor and the exposure means are both provided in the unit, and the unit is attachably and detachably provided with respect to the image forming apparatus main body. By replacing the unit itself, the photoreceptor in the unit is automatically replaced. So, the photoreceptor (consumable goods) can be replaced at the user's end with ease.

In addition thereto, the new unit having a new photoreceptor is attached to the image forming apparatus main body, so the relative positional relation between the photoreceptor and the exposure means is kept so as to be in a predetermined relation. Namely, since the unit itself is replaced, the user does not need the professional skill, for positioning in the unit the photoreceptor with respect to the exposure means, which is required for the conventional arts. Thus, the maintenance can be made with ease and with high accuracy, thereby enabling to carry out the image forming with high reliability.

In order to achieve the foregoing object, another image forming apparatus of the present invention may be provided with:

an image forming apparatus main body;

a photoreceptor, rotatably provided in a unit, which is made of a transparent material and has a cylindrical shape;

exposure means, provided on the inner surface side of the photoreceptor, for exposing the photoreceptor, and moving means, movably provided with respect to a shaft direction of the photoreceptor during attaching and detaching of the unit with respect to the image forming apparatus main body, for supporting the unit, wherein the exposure means becomes located on an inner surface side of the photoreceptor after the unit is attached to the image forming apparatus main body by the moving means.

With the arrangement, the unit is moved in the shaft direction of the image forming apparatus main body so that the unit is attached to or detached from the image forming apparatus main body. By replacing the unit itself, the photoreceptor in the unit is automatically replaced together. So, the photoreceptor (consumable goods) can be replaced at the user's end with ease.

In addition thereto, since the exposure means is provided on the image forming apparatus main body side, when the new unit having a new photoreceptor is attached to the image forming apparatus main body, the relative positional relation between the photoreceptor and the exposure means is kept in a predetermined relation. Namely, since the unit itself is replaced, the user does not need the professional skill, for positioning in the unit the photoreceptor with respect to the exposure means, which is required for the conventional arts. Thus, the maintenance can be made with ease and with high accuracy, thereby enabling to carry out the image forming with high reliability.

It is another object of the present invention is to provide an image forming apparatus which can avoid, by removing the contaminated materials such as toners which are adhered to the inner surface of the photoreceptor, that the exposure is not appropriately carried out.

In order to achieve the foregoing object, the foregoing image forming apparatuses are further provided with cleaner means, provided in the unit so as to be on the inner surface side of the photoreceptor, for transporting contaminated materials adhered to the inner surface of the photoreceptor in a shaft direction of the photoreceptor.

With the arrangement, in the case where the contaminated materials such as toners come into the inside of the photoreceptor, the contaminated materials are removed by the cleaner means in the shaft direction of the photoreceptor. So, it is surely avoidable that the contaminated materials on the inner surface of the photoreceptor cause the exposure with respect to the photoreceptor not to be appropriately carried out. Thus, it ensures to carry out the image forming with high reliability.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, and thus, are not limitative of the present invention.

DESCRIPTION OF THE EMBODIMENTS

The following description deals with one embodiment of the present invention with reference to FIGS. 1 through 28.

Figure 2:
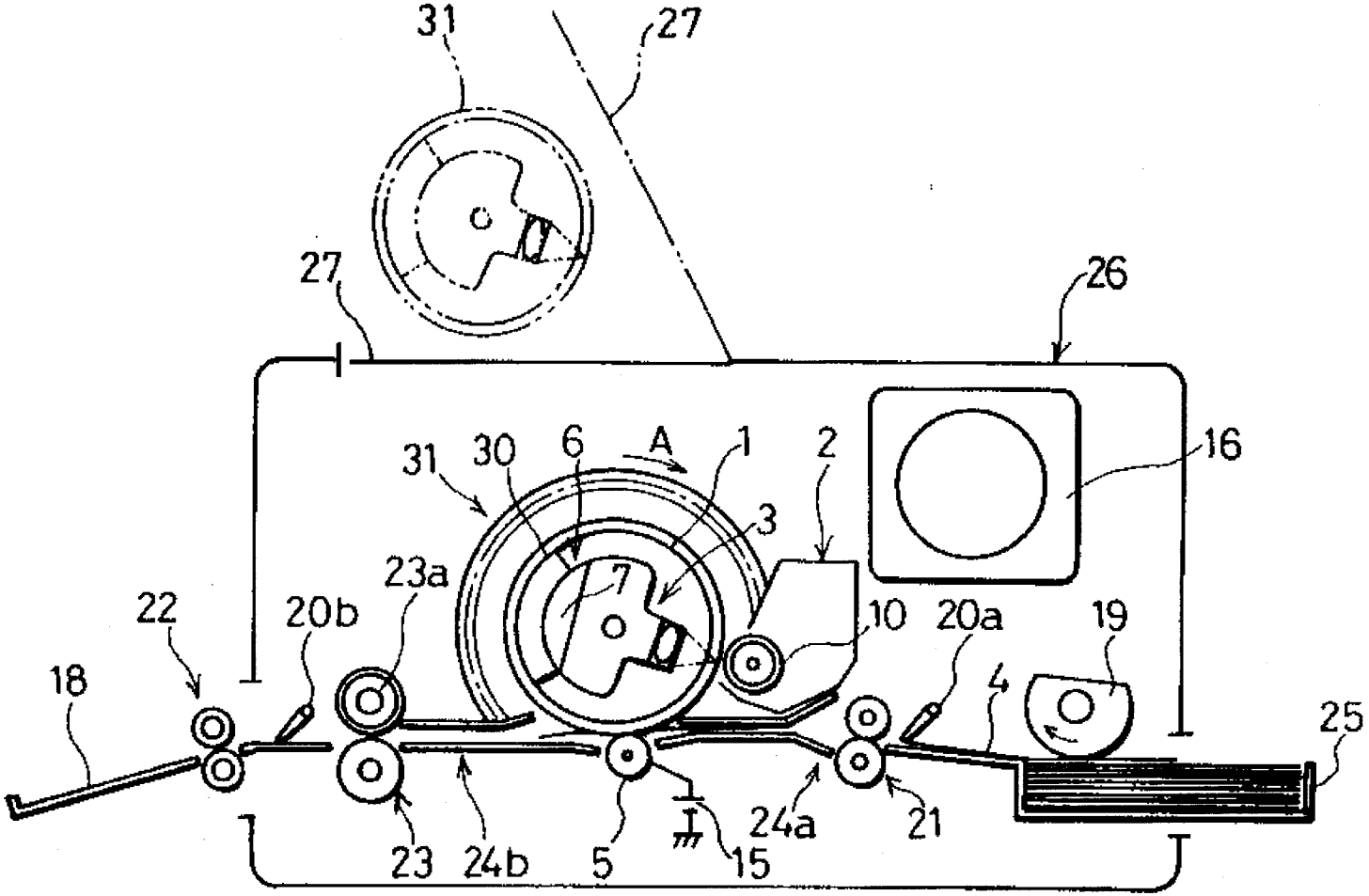
FIG. 2 is a schematic view illustrating the structure of the image forming apparatus.

An image forming apparatus in accordance with the present embodiment, as illustrated in FIG. 2, is provided with a photoreceptor drum 1 (photosensitive body) in a predetermined position of an image forming apparatus main body 26, the photoreceptor drum 1 being rotatable in an arrow direction A and having a cylindrical shape. There is provided a developer 2 on one side of the photoreceptor drum 1, i.e., on the right side of the photoreceptor drum 1 in FIG. 2. There is provided a transfer roller 5 under the photoreceptor drum 1. There are provided an optical system 3 (exposure means) and a cleaner 6 (removing means) in the photoreceptor drum 1, i.e., on the inner surface side thereof. The developer 2 is arranged so as to face the optical system 3 through the photoreceptor drum 1. The cleaner 6 is arranged so as to turn its back to an LED array 14 and is fixed to a predetermined portion of the optical system 3. The photoreceptor drum 1, the optical system 3 and the cleaner 6 form a unit 31 which is later described in detail. There is provided an eraser (not illustrated) in a predetermined portion of the outside of the photoreceptor drum 1.

There is formed a copy paper feeding path 24*a*, having a pair of resist rollers 21 and other members, on the copy paper feeding side of the photoreceptor drum 1. The pair of resist rollers 21 feed a copy paper 4 to the photoreceptor drum 1 in accordance with a predetermined timing. There is provided, on the upper stream of the copy paper feeding path 24*a*, a detection switch 20*a* for detecting that the copy paper 4 has been fed, and a copy paper feed cassette 25 for stacking the copy paper 4 thereon. There is provided, above the copy paper feed cassette 25, a copy paper feeding roller 19 for feeding the copy paper 4. The copy paper feeding roller 19 feed each copy paper 4 stacked in the copy paper feed cassette 25 to the copy paper feeding path 24*a*. The transfer roller 5 presses the copy paper 4 fed by the resist rollers 2 so as to come into contact with the photoreceptor drum 1.

There is formed a copy paper feeding path 24*b* on the copy paper discharging side of the photoreceptor drum 1. The copy paper feeding path 24*b* is provided with a fuser 23, a detection switch 20*b* for detecting that the copy paper 4 has been discharged, a pair of discharge rollers 22 and other devices. There is provided, on the lowest side of the copy paper feeding path 24*b*, a discharging tray 18 for stacking the discharged copy paper 4. The fuser 23 has a heater 23*a*, and applies the heat and pressure with respect to a toner image transferred to the copy paper 4 so as to be fused. The discharge rollers 22 discharges the fused copy paper 4 onto the discharging tray 18.

There is provided, in a predetermined portion of the image forming apparatus main body 26, a main motor 16 as the driving source of the entire apparatus. There is provided an upper lid 27 in the upper portion of the image forming apparatus main body 26. The upper lid 27 is opened as shown in an alternate long and two-dashed line during the attachment and detachment of the unit 31 (later described), though the upper lid 27 is ordinarily closed. There are provided an operation panel and display device (both not illustrated) on the upper surface of the image forming apparatus main body 26. The operation panel has keys such as a ten-key for setting the number to be copied and the reduction/enlargement ratio for copying, and a print start key. The display device carries out the error displays upon occurrence of some errors due to the image forming apparatus main body.

Figure 1:
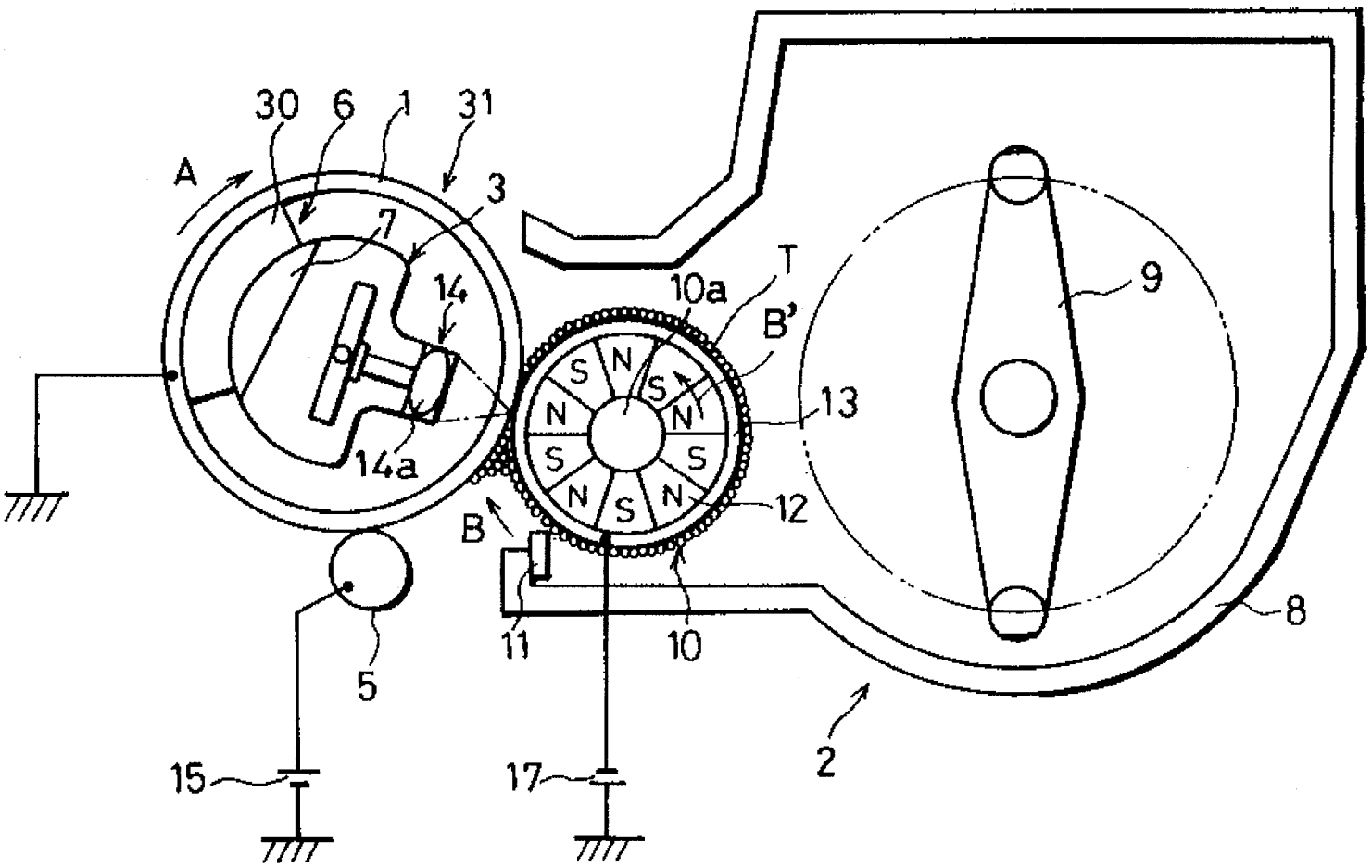
FIG. 1 is a view illustrating the structure of the main portion of an image forming apparatus in accordance with one embodiment of the present invention.
Figure 3:
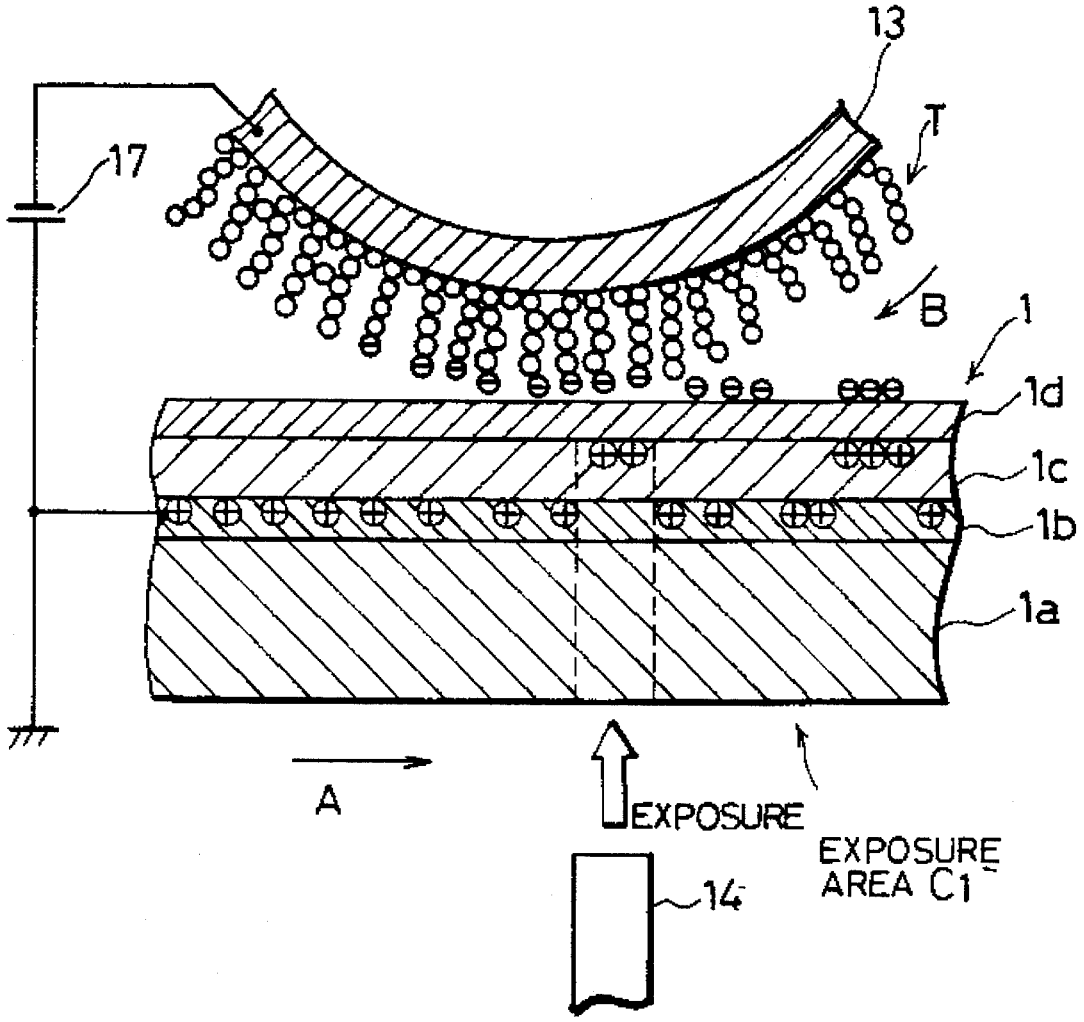
FIG. 3 is an explanatory view illustrating how a toner image is formed on the surface of the photoreceptor drum in the image forming apparatus.

As illustrated in FIG. 3, the photoreceptor drum 1 is arranged so that a transparent conductive layer 1*b*, a photoconductive layer 1*c* made of photoconductive material and an insulator layer 1*d* are luminated in this order on the outer surface of a transparent substrate 1*a*, the transparent substrate 1*a* having a cylindrical shape and being made of a transparent material such as glass. The transparent conductive layer 1*b* is made of an $In_2O_3$ film, having a thickness of about 0.5 micron, which is formed by methods such as the sputtering method. The transparent conductive layer 1*b* is electrically grounded to the earth at a predetermined portion of one end of the photoreceptor drum 1 in a shaft direction thereof. The photoconductive layer 1*c* is made of amorphous Si film having a thickness of about 3 microns for instance. The insulator layer 1*d* is made of an polyethylene terephthalate (PET) for instance. The transparent conductive layer 1*b* may be an $SnO_2$ film. The photoconductive layer 1*c* may be made of films such as Se film, ZnO film and CdS film. The respective film thicknesses of the transparent conductive layer 1*b*, the photoconductive layer 1*c* and the insulator layer 1*d* are not limited to the above-mentioned thicknesses. As illustrated in FIG. 1, the developer 2 is composed of a developer vessel 8, a stirring roller 9, a toner holder 10, a doctor blade 11 and a toner hopper having a toner supplying roller (not illustrated). The developer vessel 8 stores a conductive magnetic toner (hereinafter referred to as toner T) which is a developer. The stirring roller 9 is rotatably provided in the developer 8, and stirs the toner T. The toner holder 10 is provided in an opening of the developer 8 so as to face the photoreceptor drum 1. The doctor blade 11 is fixedly provided in the opening section of the developer 8 so as to be located under the toner holder 10. The toner hopper is provided in the upper portion of the stirring roller 9 so as to store the toner T. The toner hopper drives the toner supplying roller to rotate and to supply the toner T to the developer 8 only when the toner T is consumed.

The toner holder 10 is composed of a magnetic roller 12, a developer sleeve 13 and a supporting shaft 10*a*. The magnetic roller 12 extends along a shaft direction of the photoreceptor drum 1, and is arranged so that an N-polar magnet and an S-polar magnet are alternately disposed around the supporting shaft 10a. The magnetic roller 12 is supported by the supporting shaft 10*a* so as to rotate around the supporting shaft 10*a* in an arrow direction B' of FIG. 1. The developer sleeve 13 is made of non-magnetic materials such as aluminum and a stainless steel which belongs to martensite family. The developer sleeve 13 is provided so as to cover the outer surface of the magentic roller 12. A predetermined voltage is applied to the developer sleeve 13 by a power source 17.

When the magnetic roller 12 rotates in the arrow direction B' while the developer sleeve 13 is stationary, an A.C. magnetic field is generated. The toner holder 10 holds the toner T on the surface of the developer sleeve 13 by the generated A.C. magnetic field. The toner holder 10 transports the toner T in an arrow direction B opposite to the rotation direction of the magnetic roller 12 (i.e., the arrow direction B') in accordance with the generated A.C. magnetic field. The doctor blade 11 adjusts the transporting amount of the toner T which is held on the surface of the developer sleeve 13 and is fed to the arrow direction B so as to fall within a predetermined amount.

The toner T is made of powder. The powder is produced by the following steps: first kneading synthetic resin made of material such as styrene acrylic copolymer with (1) iron powder, (2) magnetic powder such as ferrite, and (3) carbon black and other materials; then the kneaded product is broken into pieces so that the size of each piece falls within a range of several microns and several tens of microns. The optical system 3 provided on the inner surface side of the photoreceptor drum 1 has an LED array 14 which is formed by combining light emitting diodes (hereinafter referred to as LED) and lenses having a short focal distance lens 14*a*. The optical system 3 projects light toward the developer 2 in accordance with an image pattern signal of the original document, the image pattern signal being sent from an exposure control device (not illustrated). The projected light is converged to the photoconductive layer 1*c* through the transparent substrate la and transparent conductive layer 1*b* of the photoreceptor drum 1 (see the alternate long and dashed line of FIG. 1). The optical system 3 and the exposure control device are electrically connected by a connector (not illustrated) provided on a fixing shaft 28 (described later). The image pattern signal of the original document is inputted to the image forming apparatus from an external input device (not illustrated), and thereafter is sent to the exposure control device.

The transfer roller 5 is made of synthetic resin whose volume resistivity is set to a predetermined value. A predetermined voltage is applied by a power source 15 to the transfer roller 5. When the voltage is applied to the transparent conductive layer 1*b* from the outer peripheral side of the photoreceptor drum 1 through the paper 4 (see FIG. 2), an electric field is generated by the transfer roller 5 for transferring the toner T to a transfer area $C_2$ of the photoreceptor drum 1 (see FIG. 5). The transfer roller 5 transfers the toner image formed on the outer surface of the photoreceptor drum 1 onto the copy paper 4 in a later described manner.

Figure 4:
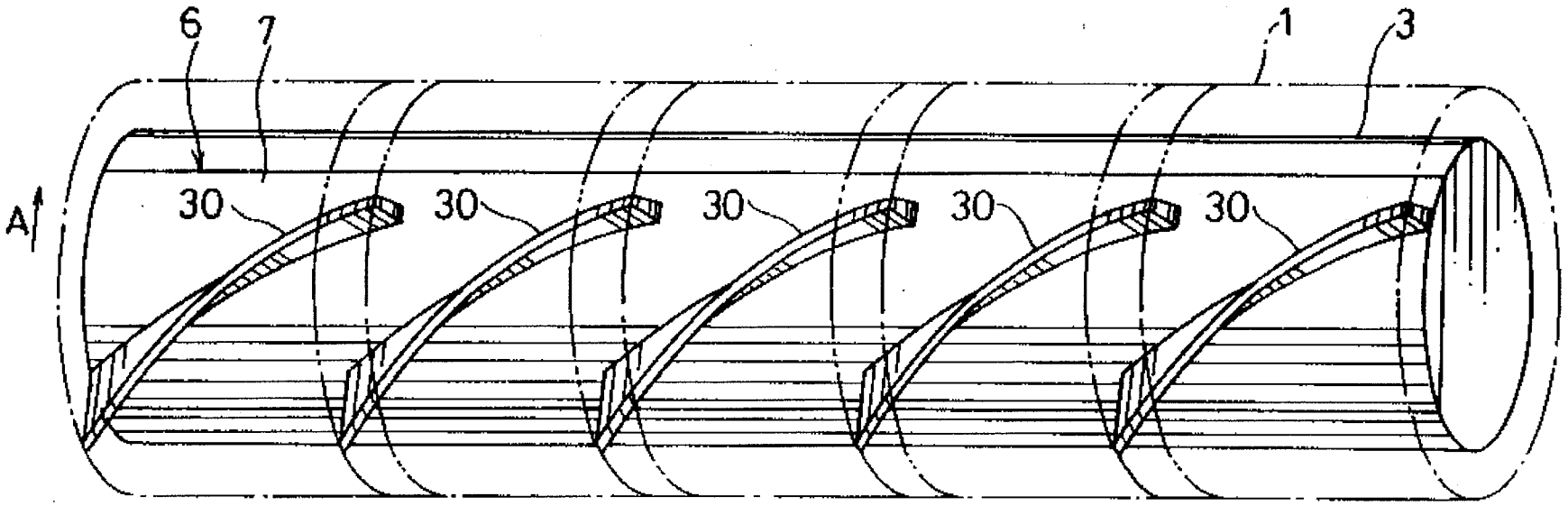
FIG. 4 is a perspective view illustrating a cleaner of the image forming apparatus.

The cleaner 6 is composed of a plurality of blades 30 and a blade holder 7 as illustrated in FIG. 4. The blade 30 is made of a material with appropriate elasticity such as synthetic resin, for example polyuretane. Each blade 30 has substantially an arch shape having a predetermined curvature and torsion, and is fixed to the blade holder 7 in a predetermined interval. The shape of the blade 30 is determined so as to be able to come into contact with the photoreceptor drum 1 with a predetermined pressure. The thickness of the blade 30 on the blade holder 7 side is thicker than that on the contacting surface side and its cross sectional shape is substantially a trapezoid so that the blade 30 itself is not deformed and the pressure and angle during contacting with the photoreceptor drum 1 are not changed. The number of the blades 30 is not specifically limited to a predetermined number.

The blade 30 comes into contact with the photoreceptor drum 1 so as to uniformly come into contact with the rear surface (the inner surface), i.e., the transparent substrate la with an angle in a reverse direction, i.e., in a counterclockwise direction with respect to the rotation direction of the photoreceptor drum 1 (an arrow direction A). Each blade 30 is disposed so that the blades 30 as a whole come into contact with the photoreceptor drum 1 in a spiral manner. Each blade 30 is fixed to the blade holder 7. More specifically, the respective blades 30 contact the inner surface of the photoreceptor drum 1 in a spiral manner so that the cleaner 6 can transport contaminated materials in the shaft direction of the photoreceptor drum 1 in accordance with the rotation of the photoreceptor drum 1.

Figure 5:
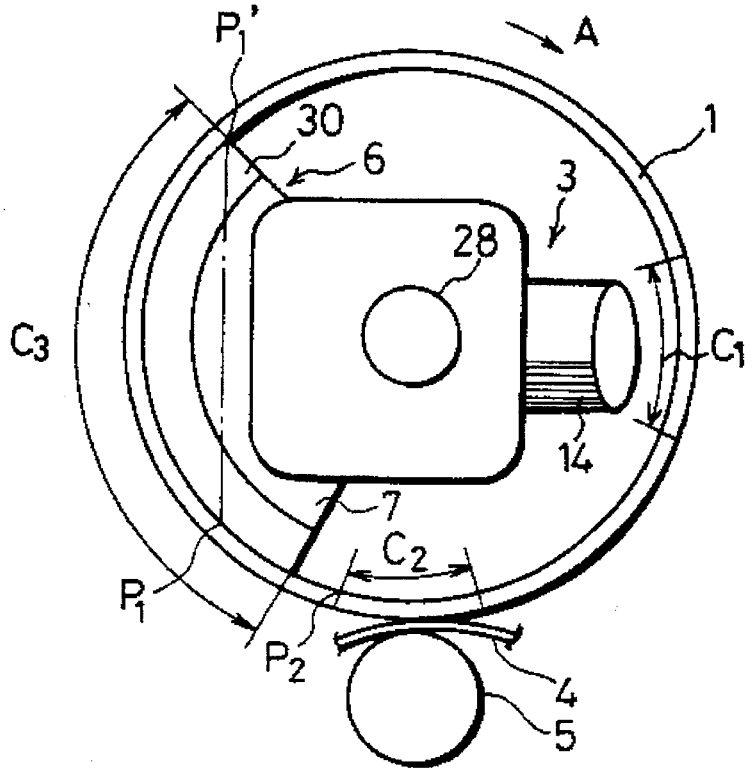
FIG. 5(*a*) is an explanatory view illustrating the positional relation, on the inner surface side of the photoreceptor drum, between the cleaner and an optical system, and FIG. 5(*b*) is an explanatory view illustrating the positional relation between a cleaning area of the cleaner and an exposure area of the optical system.
Figure 5:
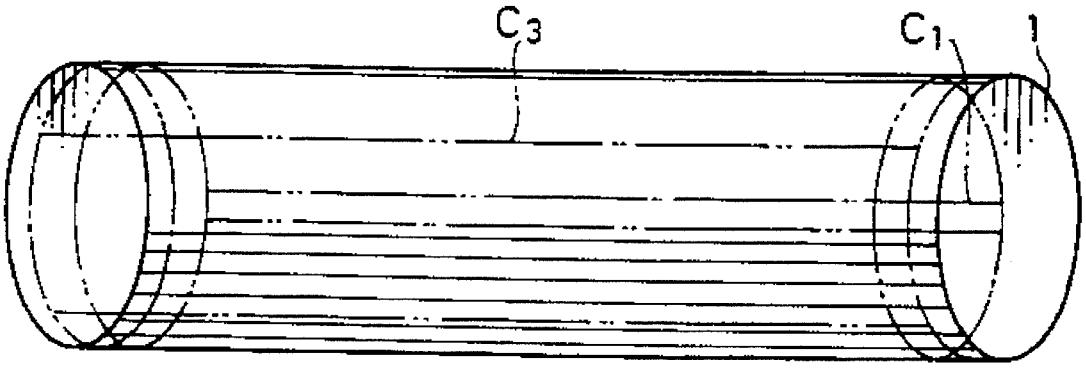

The curvature of each blade 30 in its attaching surface of the blade holder 7 is substantially the same as that of the photoreceptor drum 1 so that each blade 30 uniformly comes into contact with the inner surface of the photoreceptor drum 1. The blade holder 7 is fixed to a predetermined portion of the optical system 3. As illustrated in FIG. 5(*a*), the cleaner 6 is disposed so that a cleaning area $C_3$ does not overlap with both transfer area $C_2$ and exposure area $C_1$. The cleaning area $C_3$ is the area where the photoreceptor drum 1 comes into contact with the blades 30. The transfer area $C_2$ is the area where the toner image is transferred to the copy paper 4. The exposure area $C_1$ is the area where the photoreceptor drum 1 is exposed. The exposure area $C_1$, the transfer area $C_2$ and the cleaning area $C_3$ are disposed so as not to affect with each other.

The cleaning area $C_3$ is determined so that a point $P_1$ is located in lower part in the arrow direction A than a point $P_2$. The point $P_1$ is an intersection of the photoreceptor drum 1 and a plumb line (see an alternate long and dashed line of FIG. 5(*a*)) extended from a point $P_1'$ which is the lowest point in the cleaning area $C_3$ in the arrow direction A. The point $P_2$ is the lowest point in the transfer area $C_2$ in the arrow direction A. With the arrangement, the contaminated materials (later described) removed from the cleaning area $C_3$ are not fallen down to the transfer area $C_2$. The width of the cleaning area $C_3$ in the shaft direction of the photoreceptor drum 1 is wider than that of the exposure area $C_1$, so that the exposure area $C_1$ is entirely kept clean (see FIG. 5(*b*)).

Figure 6:
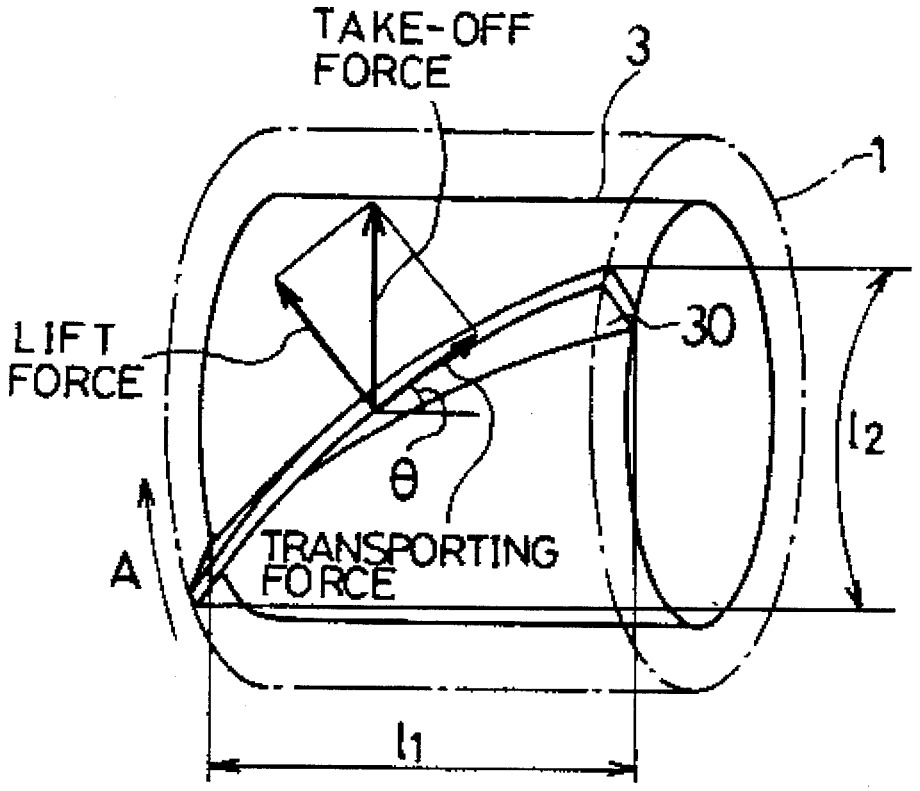
FIG. 6 is an explanatory view illustrating forces exerted on the contaminated material which should be removed by the cleaner.

The blade 30 fixed in the foregoing manner, as illustrated in FIG. 6, is pressed and come into contact with the inner surface of the photoreceptor drum 1 so as to have a predetermined angle θ with respect to the shaft direction of the photoreceptor drum 1. When the photoreceptor drum 1 rotates in the arrow direction A, the contaminated materials on the inner surface of the photoreceptor drum 1 (not illustrated), such as the toner T which was dispersed from the developer 2 and reached the inner surface, receive a lift force in a direction vertical to the blade 30. The component of the lift force in the arrow direction A (in the rotation direction of the photoreceptor drum 1) exerts as a force for taking the contaminated materials off the inner surface of the photoreceptor drum 1. The component of the lift force in a directon in which the blade is fixed exerts as a force for transporting the contaminated materials to the shaft direction of the photoreceptor drum 1 (in the right direction of FIG. 6). Accordingly, when the photoreceptor drum 1 rotates in the arrow direction A, the blades 30 take the contaminated materials off the inner surface of the photoreceptor drum 1 so that the contaminated materials are transported to the shaft direction of the photoreceptor drum 1.

The transporting force varies depending on the length ratio $I_2/I_1$ where the length $I_1$ indicates a length of the blade 30 in the shaft direction of the photoreceptor drum 1 and the length $I_2$ indicates a length of the blade 30 in a circumferencial direction of the photoreceptor drum 1. Accordingly, when the length $I_2$ is fixed, the shorter the length $I_1$ (i.e., the greater the ratio $I_2/I_1$) becomes, the greater the transporting force becomes. However, the blade 30 should be disposed so that the cleaning area $C_3$ does not overlap with both the transfer area $C_2$ and the exposure area $C_1$. Therefore, the length $I_2$ in the circumferencial direction is limited to a length of not more than a predetermined length, and the length $I_1$ in the shaft direction is limited to a length of not more than the length of the photoreceptor drum 1. In order to meet the requirements, according to the cleaner 6 of the present embodiment, the plurality of blades 30 are disposed in a predetermined interval so that the length ratio $I_2/I_1$ of each blade 30 becomes great, thereby making the transporting force of the contaminated materials great.

As illustrated in FIG. 4, the neighboring blades 30 contacting the inner surface of the photoreceptor drum 1 are disposed so as to partially overlap with each other (see the alternate long and two-dashed line in the Figure). So, the inner surface of the photorecptor drum 1 is kept clean, and the contaminated materials, which were taken off by the first blade 30 located on the left side of the figure, are consecutively tansported in the shaft direction of the photoreceptor drum 1 so as to transport them to the neighboring second blade 30 located on the right side through the overlapped area. With the arrangement, the blades 30 in the cleaner 6 can remove the contaminated materials on the inner surface of the photoreceptor drum 1.

The abolition of the contaminated materials, which have been removed by the cleaner 6, from the unit 31 is later described.

Figure 10:
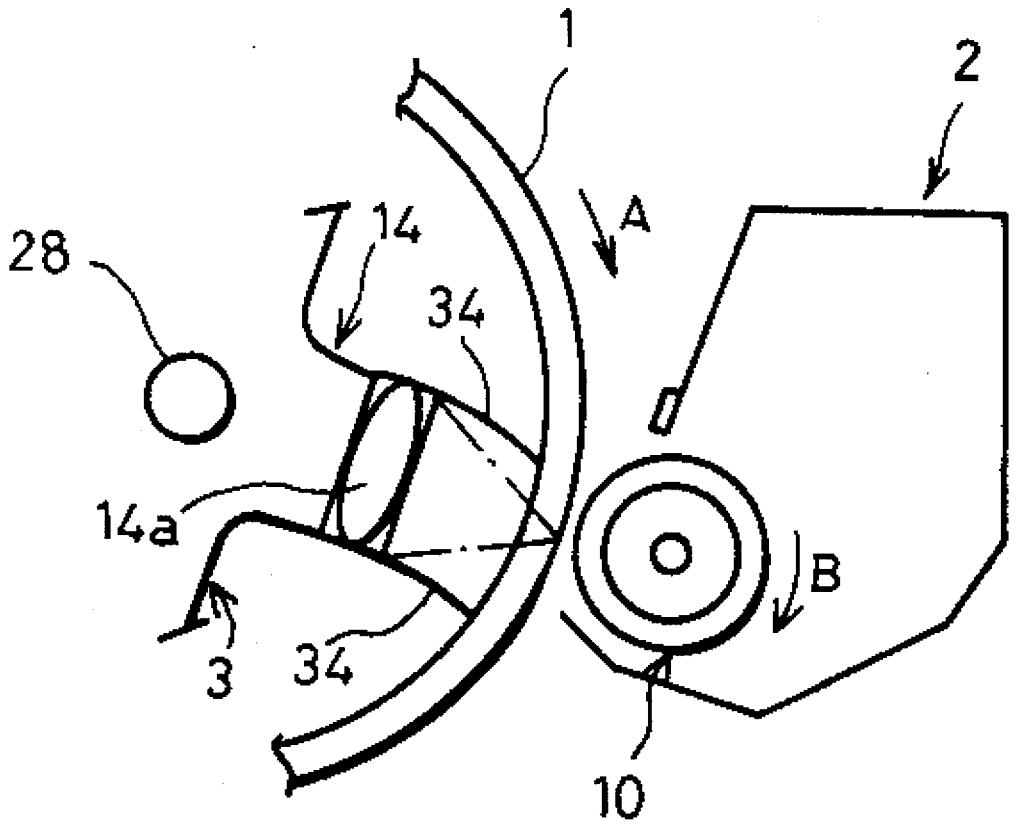
FIG. 10 is a schematic sectional view illustrating the structure of the main portion of the image forming apparatus.

As illustrated in FIG. 10, the LED array 14 of the optical system 3 has protection members 34 in its top end section. The protection members 34, made of flexible synthetic resin such as polycarbonate, has a film shape. The protection members 34 protects the focal lens 14*a* so that the contaminated materials is not adhered to the focal lens 14*a*. Because of the protection, the focal lens 14*a* is kept clean, thereby ensuring that the exposure is appropriately carried out. The protection members 34 do not contact the inner surface of the photoreceptor drum 1. Thus, the contaminated materials on the inner surface of the photoreceptor drum 1 are never be adhered to the protection members 34.

Figure 7:
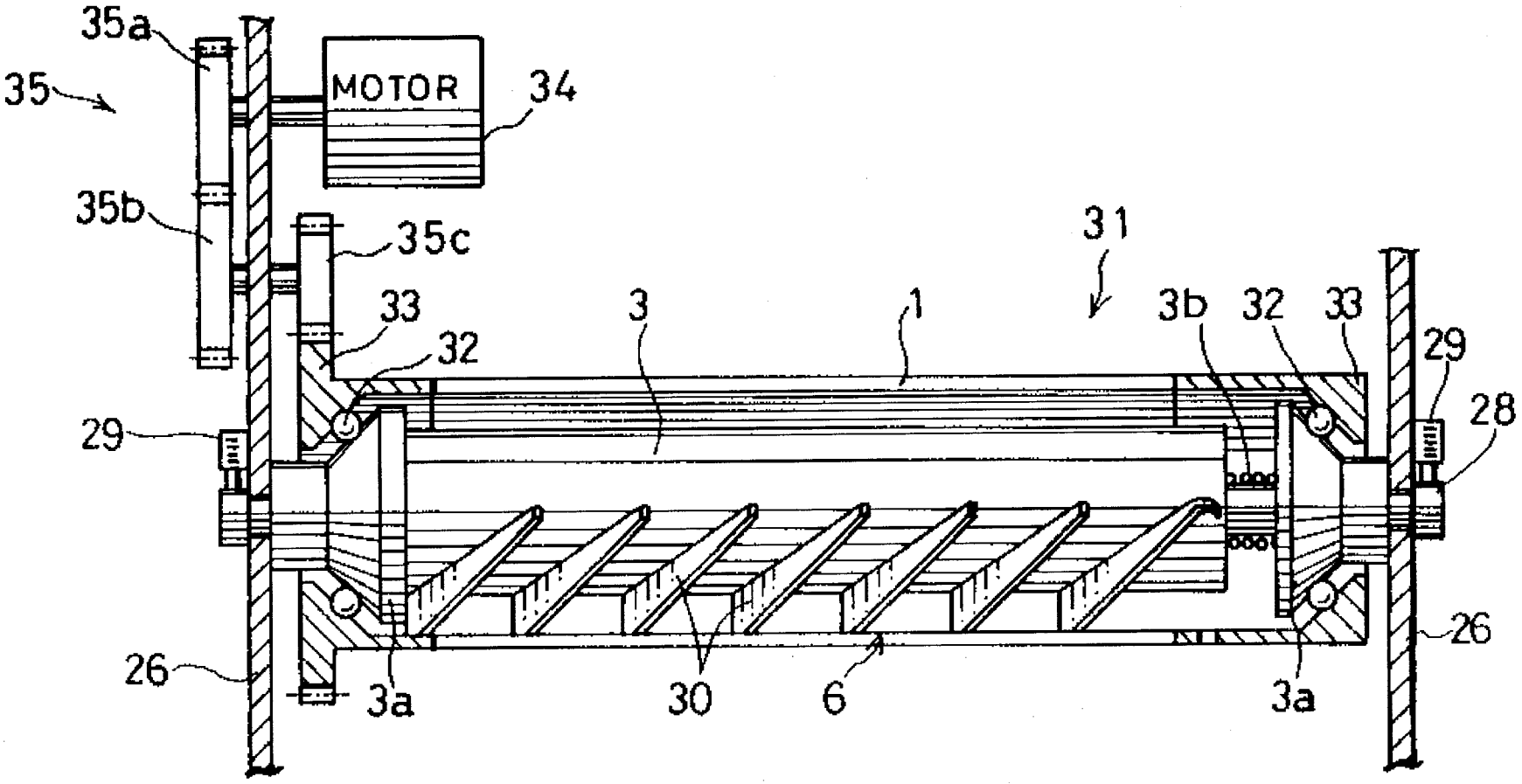
FIG. 7 is a schematic sectional view illustrating the structure of a unit of the image forming apparatus.
Figure 8:
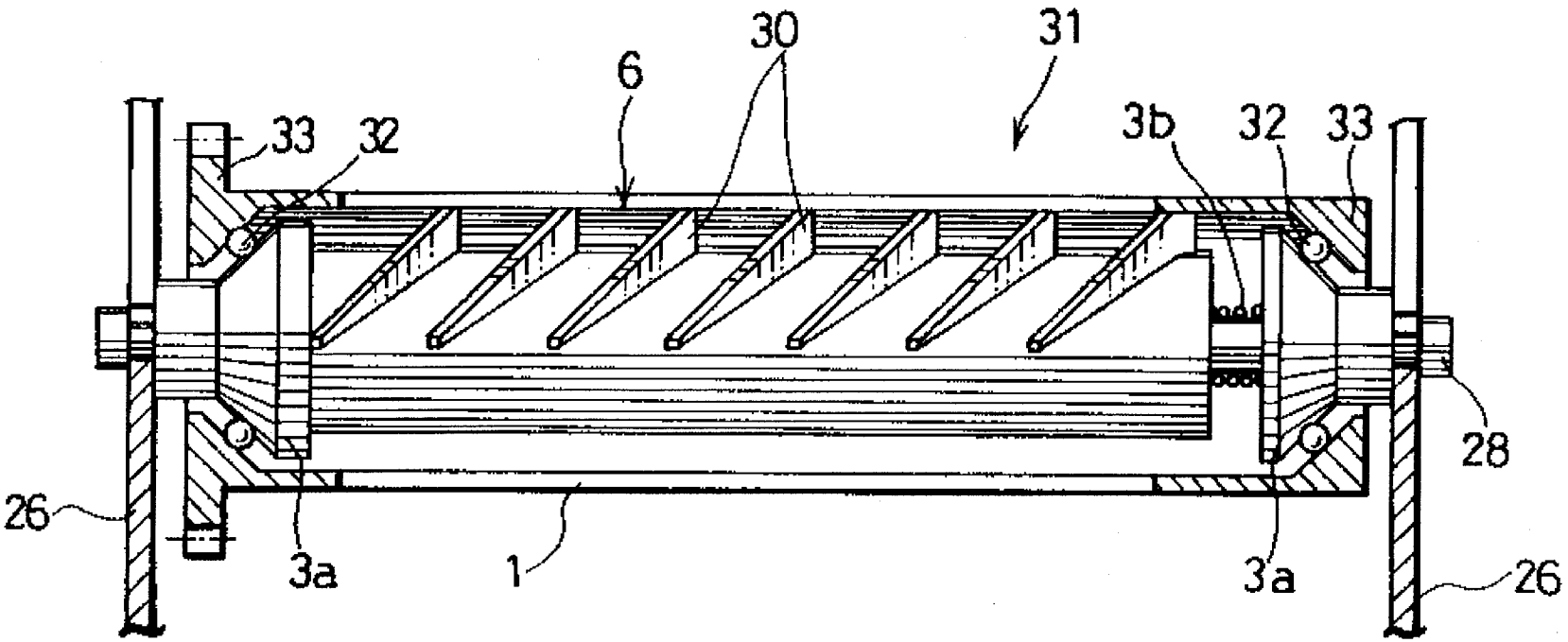
FIG. 8 is a schematic sectional view illustrating the structure of the unit.

As illustrated in FIGS. 7 and 8, the photoreceptor drum 1, the optical system 3 and the cleaner 6 are united so as to form the unit 31. There is provided fixing members 3*a* connecting each end of the fixing shaft 28 for fixing the optical system 3. One of the fixing members 3*a* (the fixing member 3*a* on the left side of FIGS. 7 and 8) is slidable in the shaft direction of the fixed shaft 28, and is pressed by a spring 3*b* so as to be away from the optical system 3. The other fixing member 3*a* is fixed to the optical system 3. Each end of the fixing shaft 28 is provided with a handle 29.

Figure 9A:
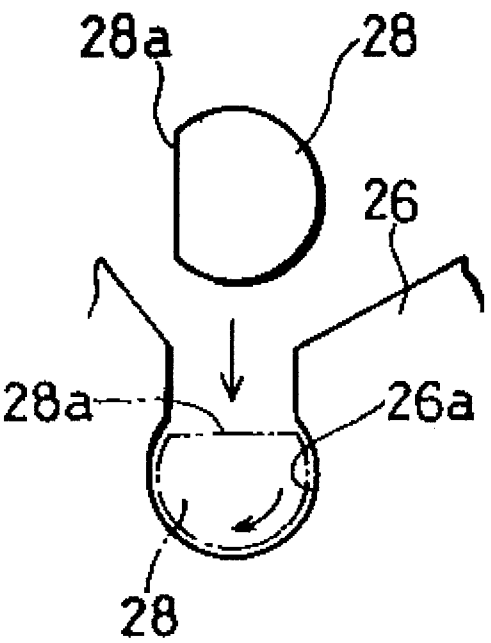
FIGS. 9(*a*) through 9(*c*) explain how to attach the unit, and FIG. 9(*a*) is a front view illustrating a fixing shaft of the unit and the main portion of a recess section of the image forming apparatus main body, FIG. 9(*b*) is a taken out of the image forming apparatus main body, and front view illustrating the state wherein the unit has been FIG. 9(*c*) is a front view illustrating the state wherein the unit has been attached to the image forming apparatus main body.
Figure 9B:
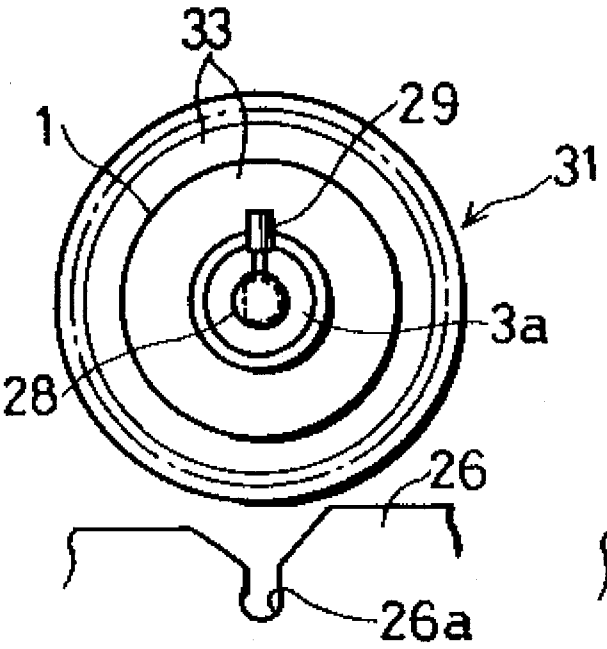
Figure 9C:
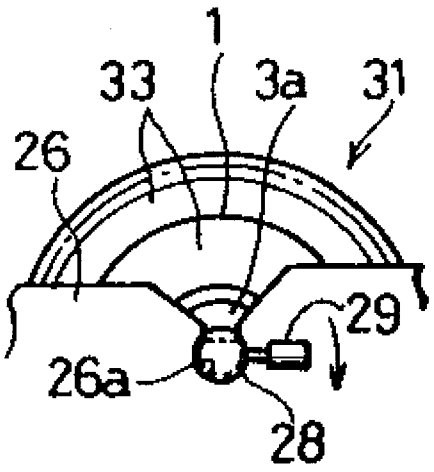

As illustrated in FIG. 9(*a*), the image forming apparatus main body 26 is provided in a predetermined portion with a recess section 26*a* for supporting the fixing shaft 28. The portion of the fixing shaft 28 corresponding to the recess section 26*a* is provided with a cutting section 28*a* of an arch shape so as to be coupled with the recess section 26*a*. The cutting section 28*a* is provided along the direction of the attachment of the handle 29.

As illustrated in FIGS. 7 and 8, each end of the photoreceptor drum 1 is provided with a driving member 33. Each driving member 33 is attached to the fixing member 3*a* through a bearing 32. Attaching means is composed of the fixing shaft 28, the driving members 33, the fixing members 3*a*, the spring 3*b*, the bearings 32 and other members.

There is provided a motor 34, in a predetermined portion of the image forming apparatus main body 26, for rotating the photoreceptor drum 1 in accordance with a rotation control signal of a rotation control device (not illustrated). The driving force of the motor 34 is transmitted to one of the driving members 33 (the driving member 33 on the left side of FIGS. 7 and 8) through gears 35*a*, 35*b* and 35*c*. With the arrangement, the photoreceptor drum 1 rotates.

There is provided a control device in a predetermined portion of the image forming apparatus main body 26. The control device controls the devices such as the exposure control device and the rotation control device in response to signals of the elements such as the detection switch 20*a* and the detection switch 20*b*. The control device also controls the devices such as the developer 2, the transfer roller 5, the pair of resist rollers 21, the copy paper feeding roller 19, the fuser 23, the pair of discharge rollers 22 and the main motor 16.

The gears 35*a*, 35*b* and 35*c* and gears in the driving member 33 (hereinafter referred to as gears 35) are helical gears having an engagement ratio of not less than 1 so as to restrain the rotation fluctuation of the photoreceptor drum 1. In general, the rotation fluctuation of the motor 34 is amplified or attenuated in accordance with the ratio of the rotation number of the shaft of the motor 34 to that of the photoreceptor drum 1. When the rotation number of the shaft is smaller than that of the photoreceptor drum 1, the rotation fluctuation is amplified. So, the gear ratio of the gears 35 is determined so that the photoreceptor drum 1 rotates slower than the shaft of the motor 34. The gears 35 may be spur gears or double helical gears.

The following description deals with how to attach the unit 31 (the optical system 3) with reference to FIGS. 9(*a*) and 9(*b*). As illustrated in FIG. 9(*b*), the fixing shaft 28 is inserted into the recess section 26*a* of the image forming apparatus main body 26 with the handle 29 located on the upper side. As illustrated in FIG. 9(*a*), the cutting section 28*a* of the fixing shaft 28 directs in the up and down direction, so that the fixing shaft 28 is not caught by the peripheral section of the recess section 26*a*. Then, as illustrated in FIG. 9(*c*), the handle 29 is blew down by 90 degree. As illustrated in FIG. 9(*a*), the fixing shaft 28 is coupled with the recess section 26*a* with the cutting section 28*a* directed upward (see an alternate long and dashed line of the Figure). The fixing members 3*a* are pressed against the image forming apparatus main body 26 by the spring force of the spring 3*b*.

With the arrangement, the unit 31 (the optical system 3) is attached to the predetermined portion of the image forming apparatus main body 26. Accordingly, the gear 35*c* is engaged to the gear in the driving member 33. Further, the optical system 3 is electrically connected with the exposure control device (not illustrated) so that the transmission of each kind of signal can be made.

When the foregoing procedures are carried out from the last step to the first step, i.e., in a reverse manner, the unit 31 can be taken out of the image forming apparatus main body 26. Thus, the unit 31 is attachable and detachable with respect to the image forming apparatus main body 26. When the photoreceptor drum 1 becomes deteriorated for instance, the image forming apparatus can be replaced at the user's end with ease. When the fixing shaft 28 is inserted into the recess section 26*a* of the image forming apparatus main body 26 so as to be coupled with each other, the unit 31 can be appropriately attached to the predetermined position of the image forming apparatus main body 26 without fine adjustments such as positioning.

The following description deals with how to abolish the contaminated materials, which were removed by the cleaner 6, from the unit 31.

Figure 11B:
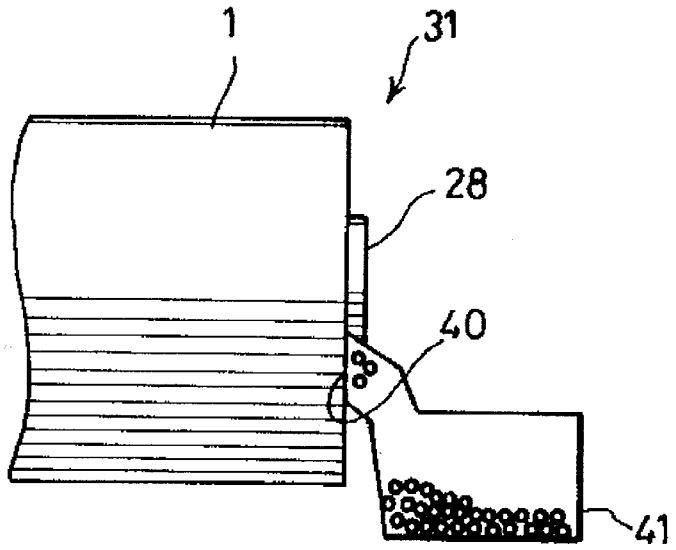
FIG. 11(*a*) is a perspective view, which is illustrated partially by a sectional view, illustrating the main portion of the unit, and FIG. 11(*b*) is a side view illustrating the main portion of the unit.
Figure 11A:
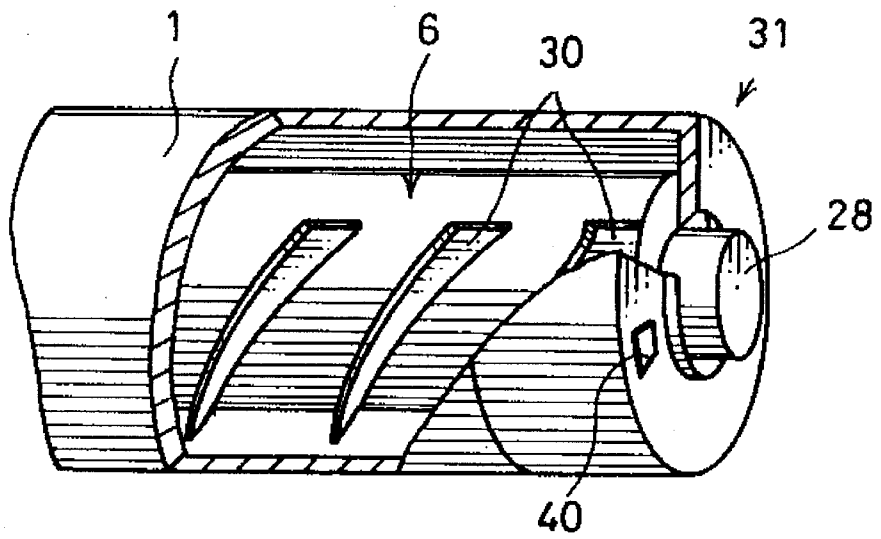

As illustrated in FIG. 11(*a*), there is provided a discharge hole 40 for discharging the contaminated materials outward in a predetermined portion on the side surface of the unit 31 in the shaft direction of the photoreceptor drum 1. The discharge hole 40 is provided at a position corresponding to the lowest part of the blade 30 which is fixed on the lowest part in the transporting direction (substantially in the right direction of the Figure) of the contaminated materials. With the arrangement, the contaminated materials, which have been transported, are discharged from the lowest part of the blade 30 outward through the discharge hole 40, when the discharge hole 40 has just reached the lowest part of the blade 30 in accordance with the rotation of the photoreceptor drum 1. As illustrated in FIG. 11(*b*), an abolition bottle 41 is attachably and detachably provided with respect to the unit 21 in a predetermined position of the unit 31 so as to cover the discharge hole 40.

Figure 12:
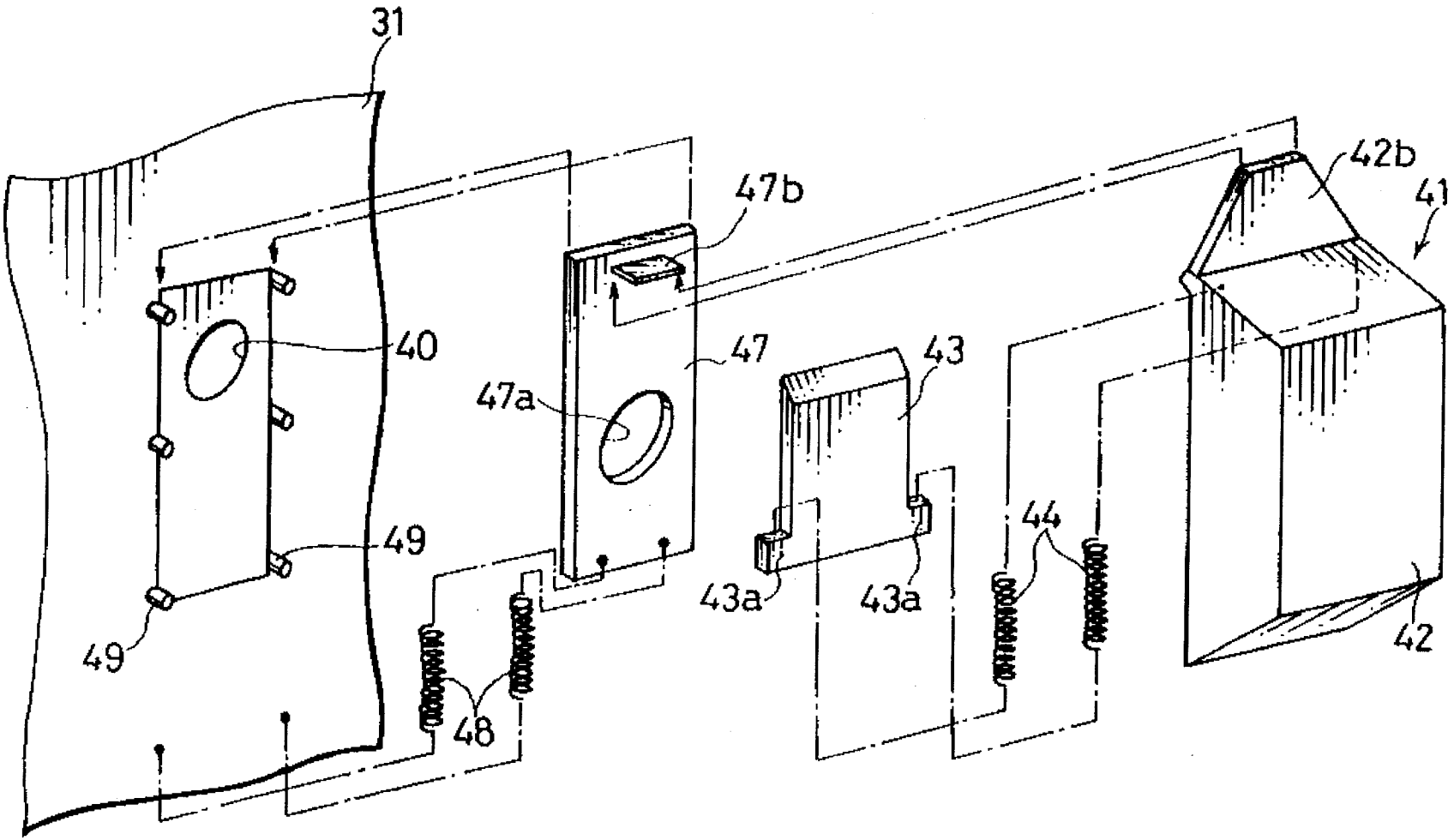
FIG. 12 is a perspective decomposition view illustrating the structure of collecting means of the unit.
Figure 13A:
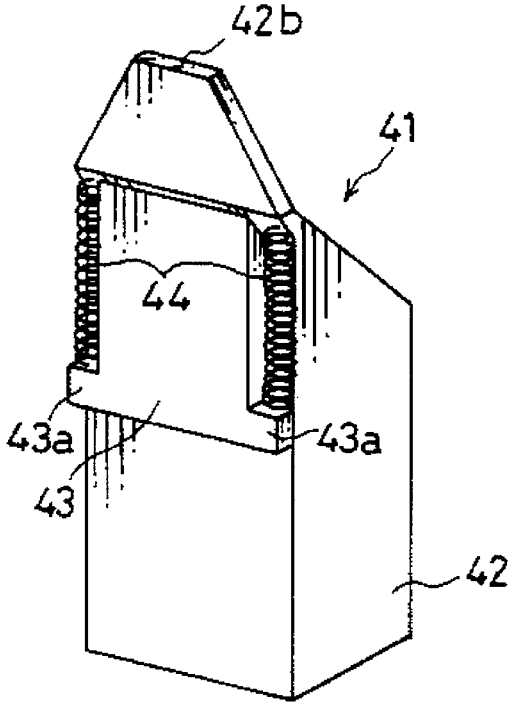
FIGS. 13(*a*) and 13(*b*) are perspective views illustrating an abolition bottle of the collecting means.
Figure 13B:
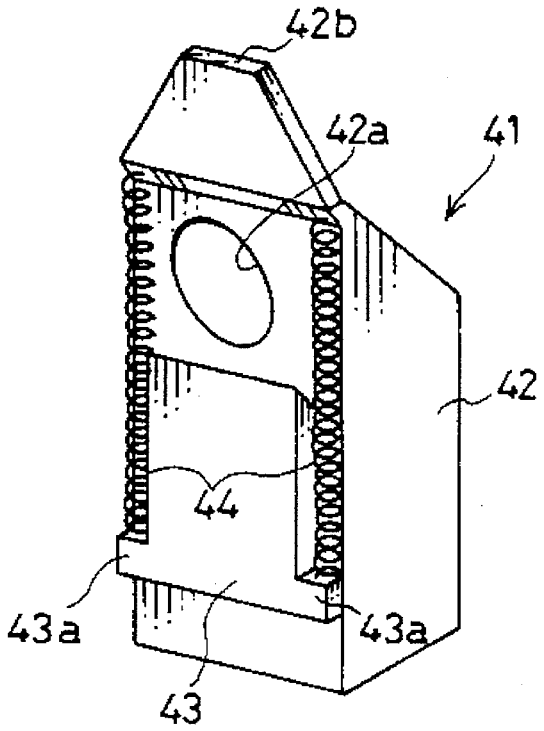

As illustrated in FIGS. 12 and 13, the abolition bottle 41 is composed of a bottle 42, a lid 43 and springs 44. The bottle 42 has a shape of container, and has an opening section 42*a* and a top section 42*b*. The lid 43 is designed in size and shape so as to close the opening section 42*a* of the bottle 42. The lid 43 is slidably attached to the bottle 42. The lid 43 has coupling sections 43*a* for coupling with respective pins 49. One end of each spring 44 is fixed to the bottle 42, while the other end of each spring 44 is fixed to the lid 43. The springs 44 always press the lid 43 in a direction (substantially upward of FIG. 13) to which the lid 43 covers the opening section 42*a*.

Figure 14B:
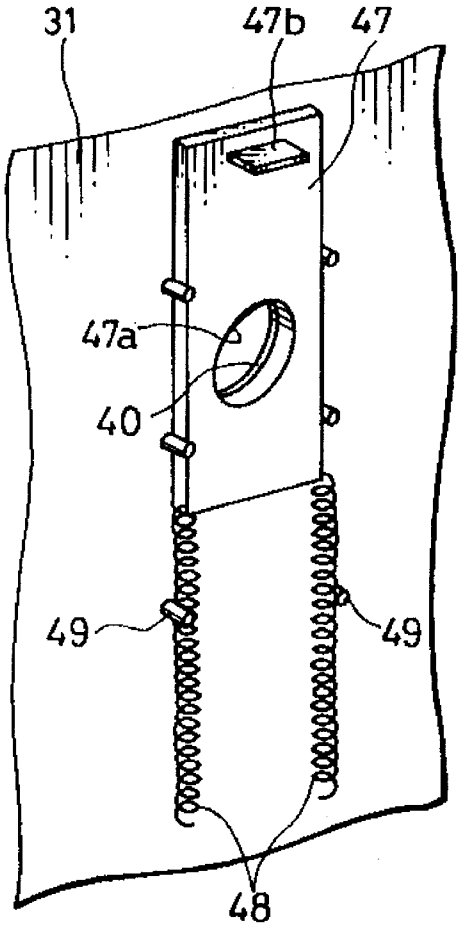
FIGS. 14(*a*) and 14(*b*) are perspective views illustrating a lid of the collecting means.
Figure 14A:
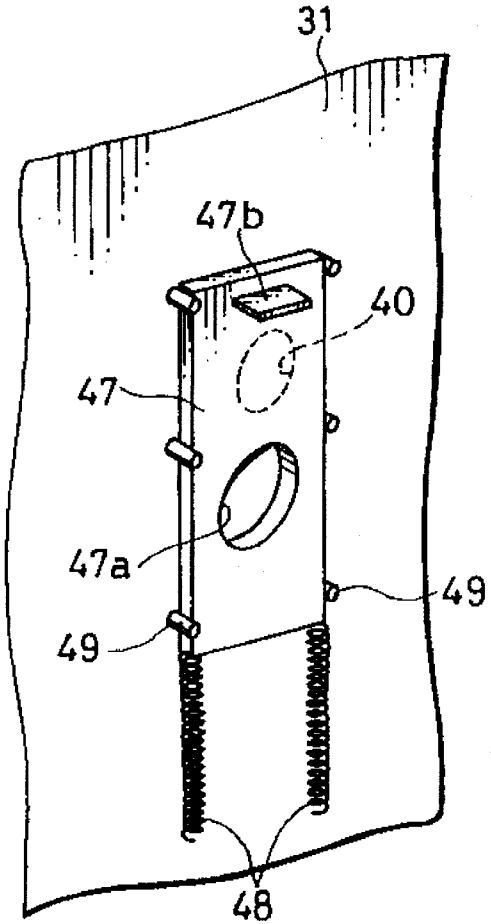

As illustrated in FIGS. 12 and 14, a lid 47 is slidably provided in the unit 31. The lid 47 is designed in size and shape so as to cover the discharge hole 40. The lid 47 has a through hole of substantially the same shape and size as those of the discharge hole 40, and has a projection section 47*b* which can come into contact with a top section 42*b* of the bottle 42 (later described). Springs 48 fixed to the unit 31 at their one end always press the lid 47 in a direction (substantially downward of FIG. 14) to which the lid 47 covers the discharge hole 40. The pins 49, for sliding the lid 43 by the coupling of the coupling section 43*a* of the lid 43 of the abolition bottle 41, is provided in the vicinity of the discharge hole 40.

Figure 15B:
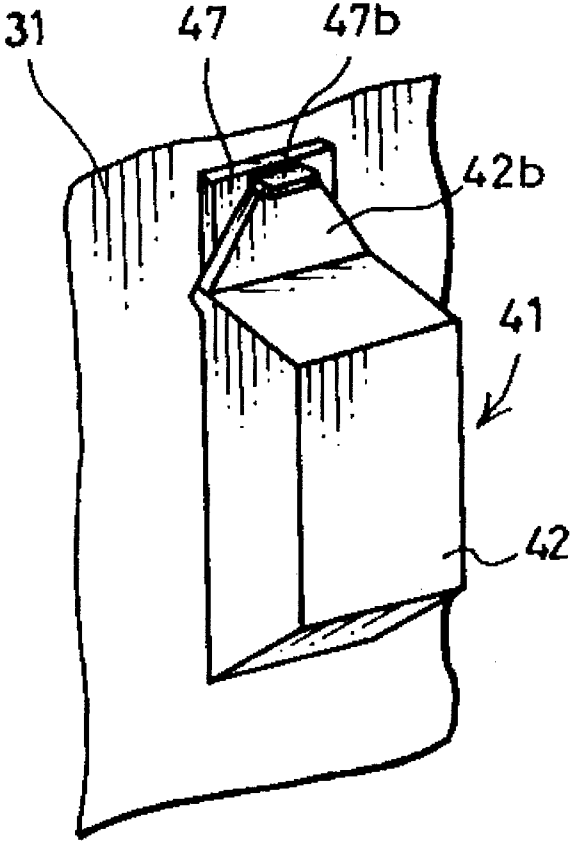
FIGS. 15(*a*) and 15(*b*) are perspective views illustrating the collecting means.
Figure 15A:
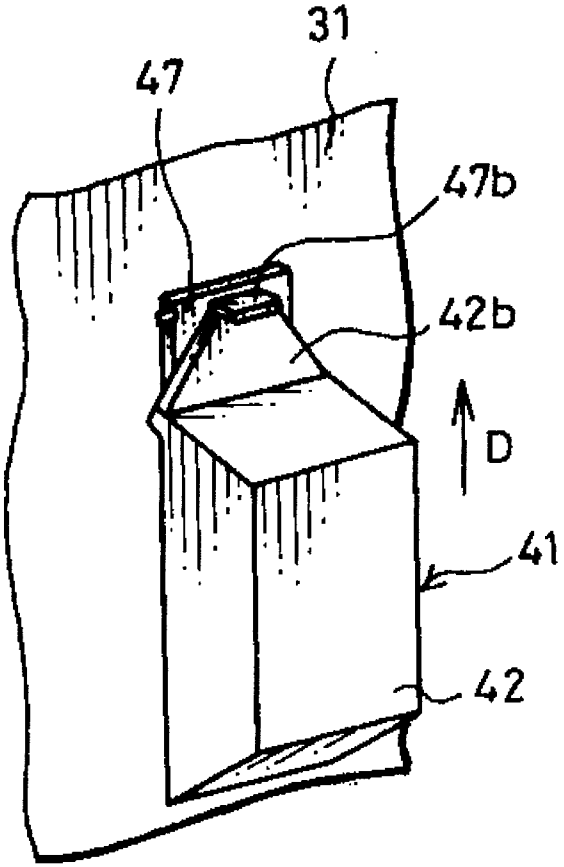
Figure 16C:
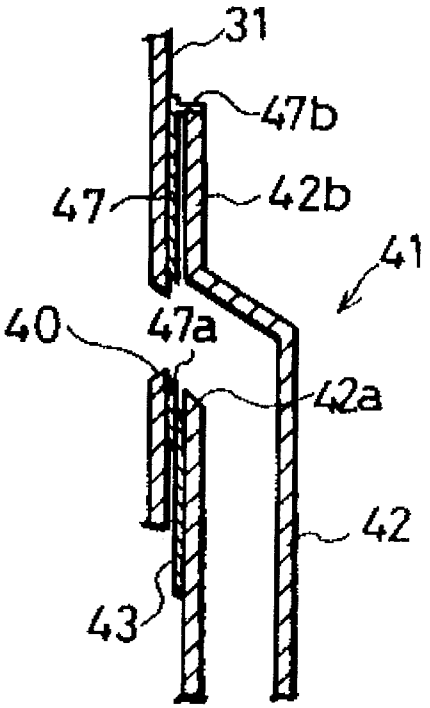
FIGS. 16(*a*) through 16(*c*) are sectional views illustrating the main portion of the collecting means.
Figure 16B:
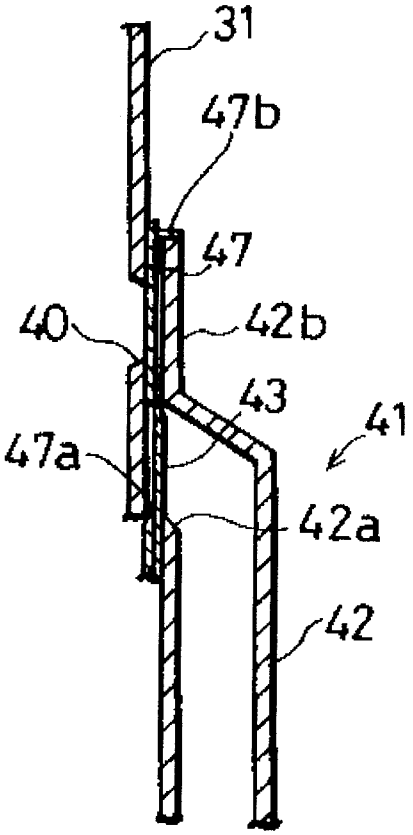
Figure 16A:
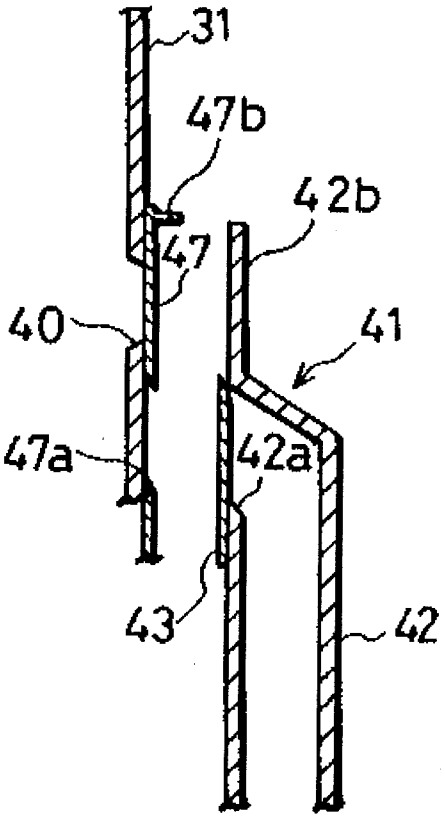

As illustrated in FIGS. 12 and 15, the abolition bottle 41 is attachably and detachably installed in a predetermined position of the unit 31 so as to cover the lid 47 with the side on which the lid 43 is provided (i.e., the side on which the opening section 42*a* is formed) directed toward the lid 47. In such a case, the top section 42*b* of the bottle 42 comes into contact with the projection section 47*b* of the lid 47 which is provided in the rotatable photoreceptor drum 1. Collecting means is composed of the abolition bottle 41, the lid 47 and other members. The shapes of the respective discharge hole 40, the abolition bottle 41, the lid 47 and other members are not limited to the foregoing shapes. Namely, provision is made as to the shapes such that the shapes are configured which can abolish the contaminated materials.

The following description deals with the attachment procedures of the abolition bottle 41 with reference to FIGS. 13 through 16.

The springs 44 cause the lid 43 of the abolition bottle 41 to cover the opening section 42*a* of the bottle 42 as illustrated in FIGS. 13(*a*) and 16(*a*), when the abolition bottle 41 has not been attached to the unit 31. As illustrated in FIGS. 14(*a*) and 16(*a*), the springs 48 cause the lid 47 to cover the discharge hole 40. Accordingly, the opening section 42*a* of the bottle 42 is covered by the lid 43 and the discharge hole 40 is covered by the lid 47, when the abolition bottle 41 is not attached to the unit 31.

In contrast, as illustrated in FIGS. 15(*a*) and 16(*a*), when the abolition bottle 41 has been attached to the unit 31, the top section 42*b* of the abolition bottle 41 comes into contact with the projection section 47*b* of the lid 47 in response to the rotation of the photoreceptor drum 1. In such a case, the pins 49 (see FIGS. 14(*a*) and 14(*b*)) are coupled with the respective coupling sections 43*a* of the lid 43 (see FIGS. 13(*a*) and 13(*b*)).

Under the foregoing conditions, when the abolition bottle 41 is slid in an arrow direction D of FIG. 15(*a*) so as to move to the position of FIG. 15(*b*), the abolition bottle 41 is attached to the predetermined portion. Therefore, the lid 43 of the abolition bottle 41 is slid in a reverse direction with reference to the sliding direction D of the bottle 42 because the coupling sections 43*a* are coupled with the pins 49. Accordingly, the opening section 42*a* of the bottle 42 is opened as illustrated in FIGS. 13(*b*) and 16(*c*). At this time, the lid 47 is slid in the same direction as the sliding direction of the bottle 42 based on the fact that the projection section 47*b* of the lid 47 is pressed by the top section 42*b* of the bottle 42. Thus, the position of the discharge hole 40 coincides with the position of the through hole 47*a* of the lid 47, thereby causing the discharge hole 40 to open (see FIGS. 14(*b*) and 16(*c*)). The discharge hole 40, the through hole 47*a* of the lid 47 and the opening section 42*a* of the bottle 42 communicate with each other.

With the attachment of the abolition bottle 41, as illustrated in FIGS. 11(*a*) and 11(*b*), the transported contaminated materials are discharged from the lowest part of the blade 30 into the abolition bottle 41 (the bottle 42) through the discharge hole 40 and the through hole 47*a* of the lid 47 when the discharge hole 40 has just reached the lowest part of the blade 30 in response to the rotation of the photoreceptor drum 1. Note that the foregoing attachment procedures should be reversely taken when the abolition bottle 41 is removed from the unit 31.

When removing the abolition bottle 41 from the unit 31, the opening section 42*a* of the bottle 42 is covered with the lid 43. This results in that the contaminated materials, which have once been discharged into the abolition bottle 41 and collected, are never be dispersed again. The contaminated materials, which have been discharged into the abolition bottle 41 and collected, are discharged with ease in such a manner that the opening section 42*a* of the bottle 42 is opened by the sliding of the lid 43 after the abolition bottle 41 is removed from the unit 31.

Figure 17:
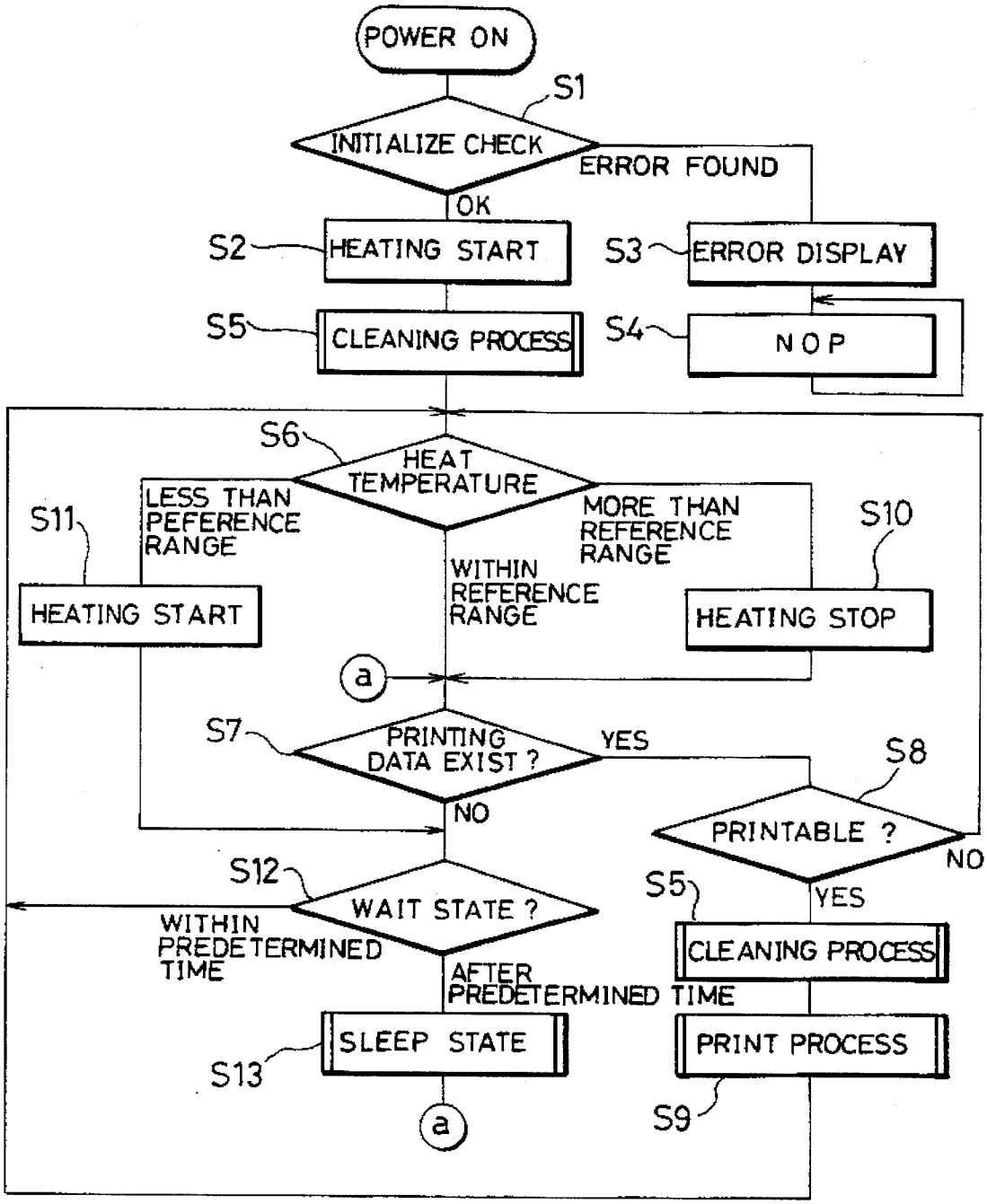
FIG. 17 is one part of a flow chart illustrating how the image forming apparatus is proceeded.
Figure 18:
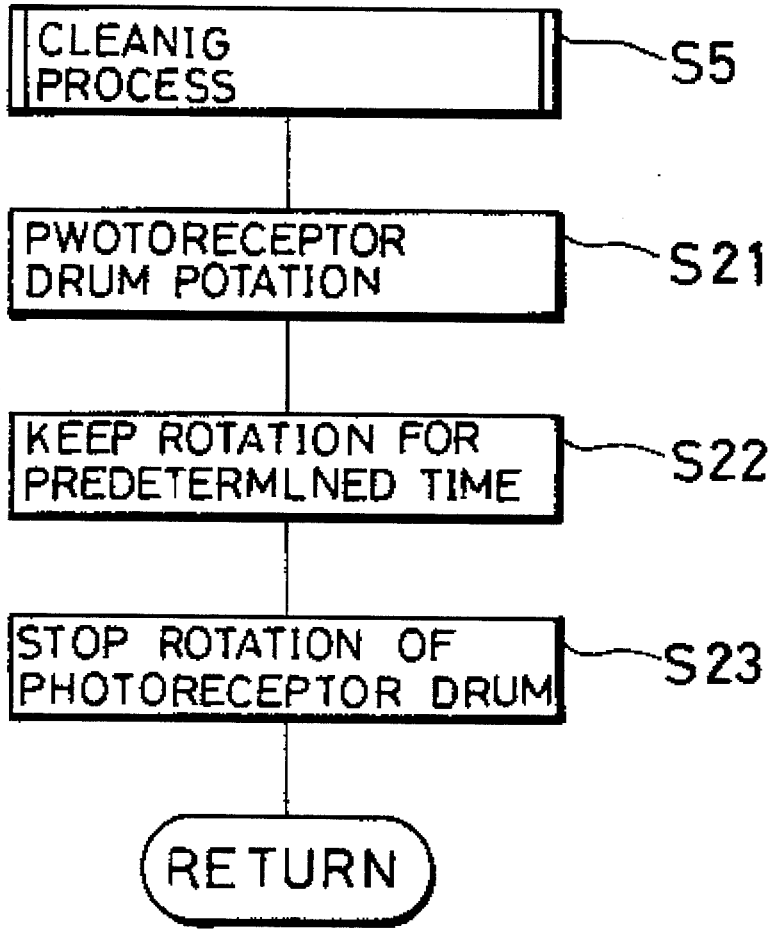
FIG. 18 is the other part of a flow chart illustrating how the image forming apparatus is proceeded.
Figure 19:
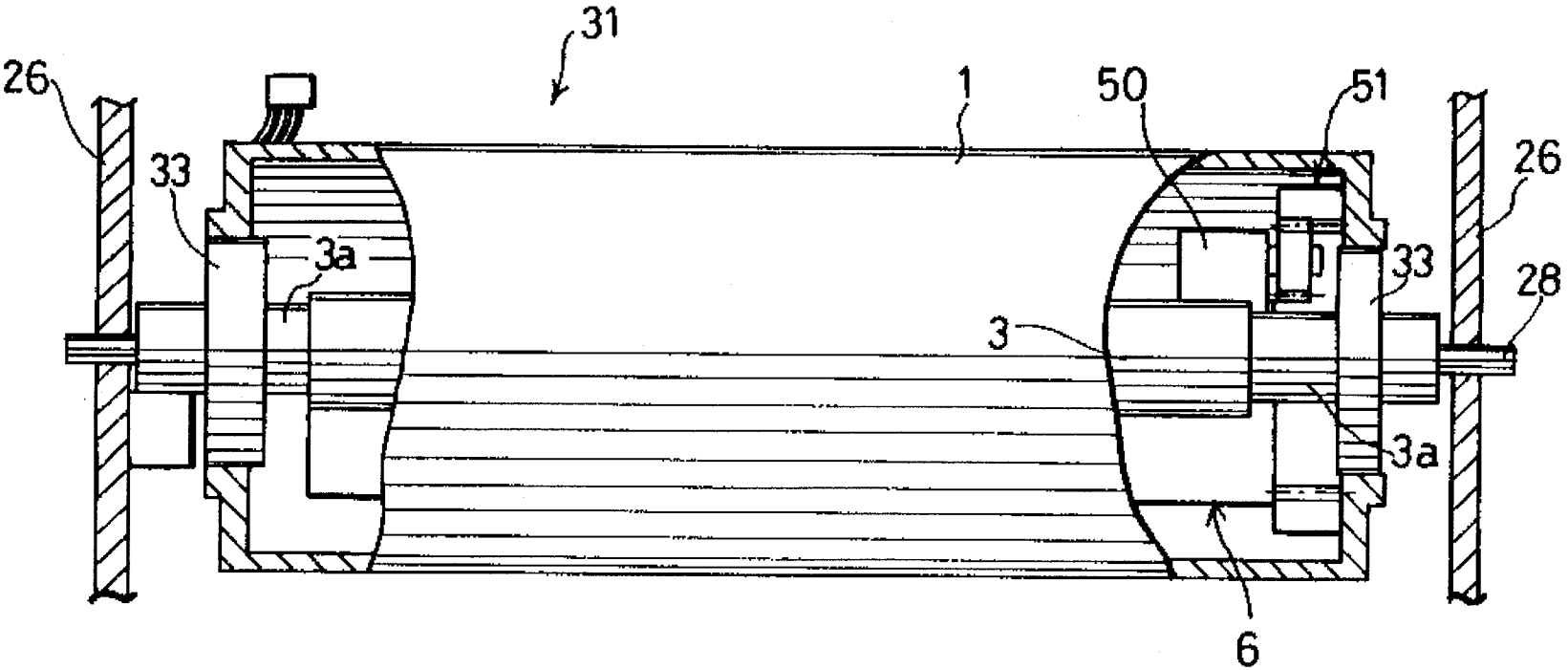
FIG. 19 is a schematic sectional view illustrating another unit (modified example) of the image forming apparatus.

The following description explains how the image forming apparatus with the foregoing structure operates with reference to FIGS. 1, 2, 3 and the flow charts of respective FIGS. 17 and 18.

First, when turning on the power source, the control device (not illustrated) checks the initial condition of each part of the apparatus (S1). When no extraordinary matter is found, the heating of the heater 23*a* of the fuser 23 is started (S2). In S1, when there are found some errors, the errors are displayed on the display device (not illustrated) (S3), thereby causing the apparatus to be in no operation condition (S4).

Next, the cleaning processes in which the cleaner 6 cleans the pthotoreceptor drum 1 (S5). The control device rotates the photoreceptor drum 1 (S21) and keeps the photoreceptor drum 1 to rotate for a predetermined period of time so as to discharge the contaminated materials into the abolition bottle 41 in accordance with the foregoing manner (S22). Thereafter, the photoreceptor drum 1 stops (S23). Thus, the cleaner 6 removes the contaminated materials on the inner surface of the photoreceptor drum 1.

Then, it is judged by the control device whether or not the temperature of the heater 23*a* of the fuser 23 falls within a reference temperature range (S6). When the temperature falls within the reference temperature range, it is judged by the control device whether or not the image pattern signal of the original document or other member is inputted, i.e., whether or not the printing data exist (S7).

When the printing data exist, it is judged by the control device whether or not the entire apparatus is in a printable condition (S8). If not so, the process goes to the step 6. In contrast, when in the printable condition, the cleaning process of the step 5 is carried out, thereafter a printing process is carried out in accordance with a later described procedure (S9). After the printing process, the process goes to the step 6.

In S6, when the temperature of the heater 23*a* is higher than the reference temperature range, the heating of the heater 23*a* is suspended (S10), thereafter going to the step 7. In S6, when the temperature of the heater 23*a* is lower than the reference temperature range, the heating of the heater 23*a* is again carried out or is started (S11), thereafter going to the step 12.

In S7, when no printing data exist, the control device controls the entire apparatus so as to become in a condition waiting for the printing data, i.e., in a waiting condition (S12). The control device repeats the procedures such as the steps 6 and 7 within a predetermined period of time. When the waiting condition has been kept for a longer period than the predetermined period, the procedures such as the heating of the heater 23 and the driving of the main motor 16 are suspended so as to reduce the consuming power. Thus, the entire apparatus changes into a so-called sleeping condition (S13). Thereafter, the control device repeats the foregoing steps such as S7 and S12 until an image pattern signal of the original document or other is inputted.

The following description deals with the printing process which is carried out in S9. First, the developing treatment of the toner T in the developer 2 is explained with reference to FIGS. 1 and 3 as follows.

When the magnetic roller 12 rotates in an arrow direction B' with the developer sleeve 13 kept stationary, the A.C. magnetic field is generated (see FIG. 1). The A.C. magnetic field holds the toner T stored in the developer vessel 8 on the surface of the developer sleeve 13. When a voltage difference of few tens of volts is applied between the developer sleeve 13 and the transparent conductive layer 1*b*, the toner T is charged as illustrated in FIG. 3. The toner T is moved on the surface of the developer sleeve 13 in a reverse direction B with respect to the arrow direction A of the photoreceptor drum 1 accordingly.

In the portion where the photoreceptor drum 1 comes into contact with the toner T on the surface of the developer 13, the injection of the electric charges is carried out from the developer sleeve 13 to the surface of the photoreceptor drum 1 through the toner T in accordance with the above-mentioned voltage diference. Thus, the surface of the photoreceptor drum 1 is charged with substantially the same electric potential as that of the developer sleeve 13. Because of substantially the same electric potential, nearly no electrostatic force (Coulomb force) is exerted between the surface of the photoreceptor drum 1 and the developer sleeve 13. The magnetic force, generated by the magnetic roller 12, is predominantly exerted on the toner T which comes into contact with the photoreceptor drum 1, thereby resulting in that the toner T is attracted to the developer sleeve 13 and is not caught by the photoreceptor drum 1.

Under the foregoing conditions, the exposure treatment is carried out by the optical system 3. More specifically, the image pattern signal of the original document is inputted by the control device (not illustrated). Then, the exposure control device consecutively selects the LEDs of the LED array 14 in the optical system 3, which corresponds to the inputted image pattern signal so as to project the light toward the portion where the toner T comes into contact with the photoreceptor drum 1. When the exposure is carried out on the inner surface side of the photoreceptor drum 1, i.e., on the transparent substrate 1*a* side, the electric resistance of the photoconductive layer 1*c* in the exposure area $C_1$ is reduced. Thus, the electric charges are injected onto the surface of the photoconductive layer 1*c*, i.e., directly downward of the insulating layer 1*d* (see FIG. 3).

Since a strong magnetic field is generated between the surface of the photoreceptor drum 1 and the developer sleeve 13, the electric charges having opposite polarity are injected into the toner T in the transfer area $C_1$. Thus, a pair of electric charges having opposite polarities with each other are formed through the insulating layer 1*d* by the charged toner T and the electric charge which is injected into the photoconductive layer 1*c*. The toner T and the photoconductive layer 1*c* attract with each other. Thereafter, the toner T stays on the surface of the photoreceptor drum 1, though the exposed portion of the photoconductive layer 1*c* is gradually away from the developer sleeve 13 in response to the rotation of the photoreceptor drum 1. An electrostatic force stronger than the magnetic force derived from the magnetic roller 12 is exerted on the toner T which comes into contact with the exposed portion. Since the electrostatic force prevails over the magnetic force, the toner T is removed from the developer sleeve 13 so as to be held on the surface of the photoreceptor drum 1. As a result, the electrostatic latent image corresponding to the image pattern signal is developed by the toner T so that the toner image is formed on the surface of the photoreceptor drum 1. As in the foregoing manner, the developing treatment of the toner T is completed by the developer 2.

Substantially at the same time, a piece of the copy paper 4 is fed from the copy paper feed cassette 25 to the copy paper feeding path 24*a* by the feeding roller 19 (see FIG. 2). When the top portion of the copy paper 4 pushes up the the detection switch 20*a*, the detection signal is inputted to the control device. The control device detects the feeding of the copy paper 4 and stops the pair of resist rollers 21. Thereafter, the control device rotates the pair of resist rollers 21 in accordance with the formation of the toner image, and feeds the copy paper 4 between the photoreceptor drum 1 and the transfer roller 5 in accordance with the predetermined timing.

The toner image formed on the photoreceptor drum 1 in the foregoing manner, as illustrated in FIG. 2, is transferred to the copy paper 4 by applying, to the transfer roller 5 in the transfer area $C_2$ where the photoreceptor drum 1 comes into contact with the transfer roller 5 (see FIG. 5), the voltage which causes to generate the electric charges having polarity opposite to that of the injected electric charges of the toner image. The applied voltage is a voltage having polarity opposite to that applied to the developer sleeve 13, and is controlled by the control device (not illustrated).

Then, the copy paper 4, to which the toner image is transferred, is fed to the fuser 23 through the copy paper feeding path 24*b*. After the toner image is fused to the copy paper 4 by the fuser 23, the copy paper 4 is discharged onto the discharge tray 18 by the pair of discharge rollers 22. During the discharging, when the top portion of the copy paper 4 pushes up the detection switch 20*b*, the detection signal is inputted into the control device, thereby resulting in that the control device detects the discharging of the copy paper 4. After elapsing a predetermined period of time from the discharging of the copy paper 4, the control device suspends the heating of the heater 23*a* and the driving of the main motor 16 so as to reduce the consuming power. Thus, the printing process is completed by the foregoing sequential procedures.

An image forming apparatus in accordance with the present embodiment, as mentioned above, the unit 31 composed of the photoreceptor drum 1 and the optical system 3 is attached to the image forming apparatus main body 26 through the attaching means composed of the fixing shaft 28, the driving members 33 and the fixing members 3*a*, and the attaching means is attachably and detachably provided with respect to the image forming apparatus main body 26.

With the structure, the attachment and detachment of the unit 31 (the photoreceptor drum 1) with respect to the image forming apparatus main body 26 can be made with ease, i.e., the replacement of the photoreceptor drum 1 can be easily made at the user's end without any professional skill. The positional relation between the photoreceptor drum 1 and the optical system 3 is kept constant by the attaching means. The accuracy of the attached positions of the respective photoreceptor drum 1 and optical system 3 with respect to the image forming apparatus main body 26 is kept always good. Since the user needs no further fine adjustment for the attaching position, no professional skill is required for the replacement of the photoreceptor drum 1. Thus, it is possible to provide an image forming apparatus in which the operations such as the maintenance can be effectively made.

Since the replacement of the photoreceptor drum 1 is made by the replacement of the unit 31, the consumable goods such as the photoreceptor drum 1 and the cleaner 6 can be replaced at a time with ease. The optical system 3 replaced by the replacement of the unit 31 is retrieved in accordance with a predetermined manner, is re-used as a new one by incorporating the retrieved one into a new unit together with a new photoreceptor drum and other new members.

An image forming apparatus in accordance with the present embodiment, as mentioned above, is provided, on the inner surface side of the photoreceptor drum 1, with the cleaner 6 for removing the contaminated materials.

With the structure, even when the contaminated materials such as the toner T come into on the inner surface of the photoreceptor drum 1 for instance, the contaminated materials can be removed. Thus, it is ensured that the exposure with respect to the photoreceptor drum 1 is appropriately carried out.

The cleaner 6 is arranged such that each plane in which the blades 30 come into contact with the inner surface of the photoreceptor drum 1 substantially is formed in the spiral manner with respect to the inner surface so as to transport the contaminated materials in the shaft direction of the photoreceptor drum 1 in response to the rotation of the photoreceptor drum 1.

With the arrangement, (1) the contaminated materials can be transported in the shaft direction of the photoreceptor drum 1 without separate transporting means, and (2) the contaminated materials can be abolished from the photoreceptor drum 1 (from the unit 31) with ease because the transported contaminated materials are collected in the shaft direction of the photoreceptor drum 1.

In addition to the foregoing structure, in the the photoreceptor drum 1, there are provided (1) the discharge hole 40 for discharging the contaminated materials, which have been transported in the shaft direction of the photoreceptor drum 1, from the inner surface toward the outer surface, and (2) the collecting means composed of the abolition bottle 41 and the lid 47 for collecting the discharged contaminated materials.

With the structure, the transported contaminated materials are discharged toward the outer surface of the photoreceptor drum 1 through the discharge hole 40 so as to be collected by the collecting means, thereby making it easier that the contaminated materials can be abolished from the unit 31, i.e., from the image forming apparatus.

The foregoing description deals with the case where the motor 34, for driving the photoreceptor drum 1 so as to rotate, is provided in the image forming apparatus main body 26 as illustrated in FIGS. 7 and 8. However, the present invention is not limited to such an arrangement, i.e., for instance, the motor for driving the photoreceptor drum 1 so as to rotate may be provided on the inner surface side of the photoreceptor drum 1. More specifically, the arrangement of FIG. 19 may be substituted therefor. Namely, a motor 50 is provided in the unit 31 for driving the photoreceptor drum 1 so as to rotate. The driving force is transmitted to the photoreceptor drum 1 through gears 51 composed of helical gears having an engagement ratio of not less than 1, thereby resulting in that the photoreceptor drum 1 rotates. The engagement ratio of the gears 51 is set such that the photoreceptor drum 1 rotates slower than the motor 50.

Figure 20:
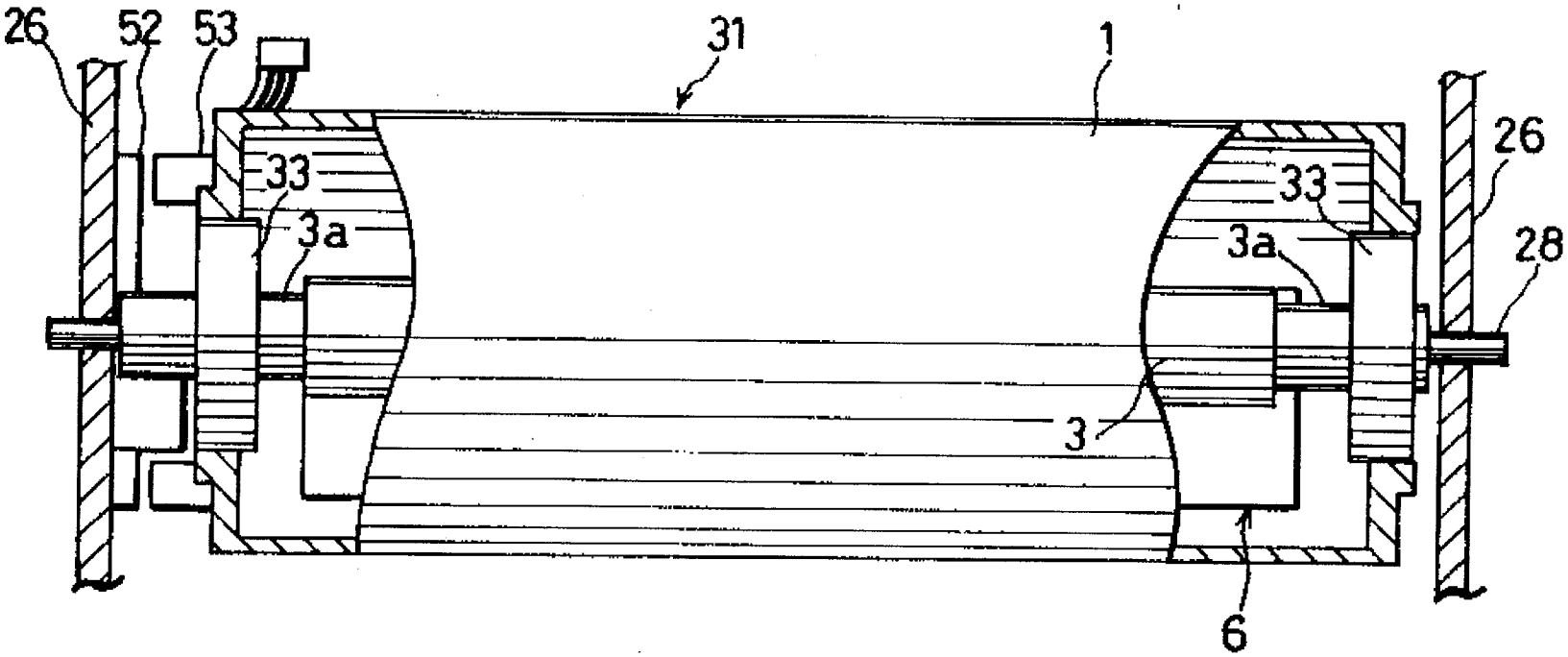
FIG. 20 is a schematic sectional view illustrating a still another unit (modified example) of the image forming apparatus.

As illustrated in FIG. 20, the following arrangement, wherein a stator 52 is provided in the image forming apparatus main body 26 while a rotor 53 is provided in correspondence with the stator 52 in the shaft direction of the photoreceptor drum 1, may be substituted for the arrangement wherein the photoreceptor drum 1 is rotated by the motor. With the arrangement, the electromagnetic force exerted between the stator 52 and the rotor 53 drives the photoreceptor drum 1 so as to rotate.

Figure 21:
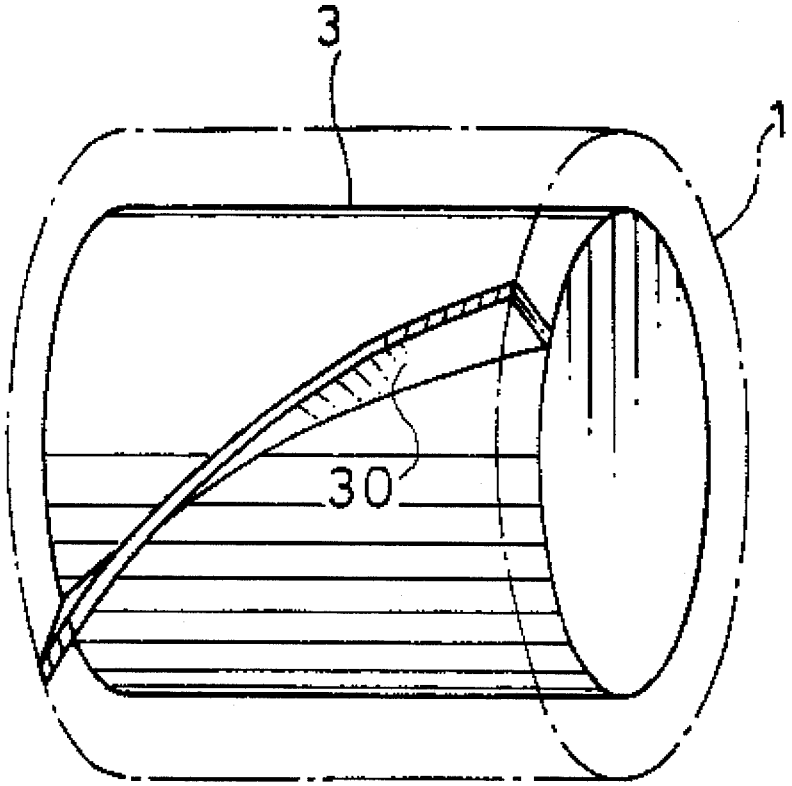
FIG. 21 is a perspective view illustrating the structure of another cleaner (modified example) of the image forming apparatus.
Figure 22:
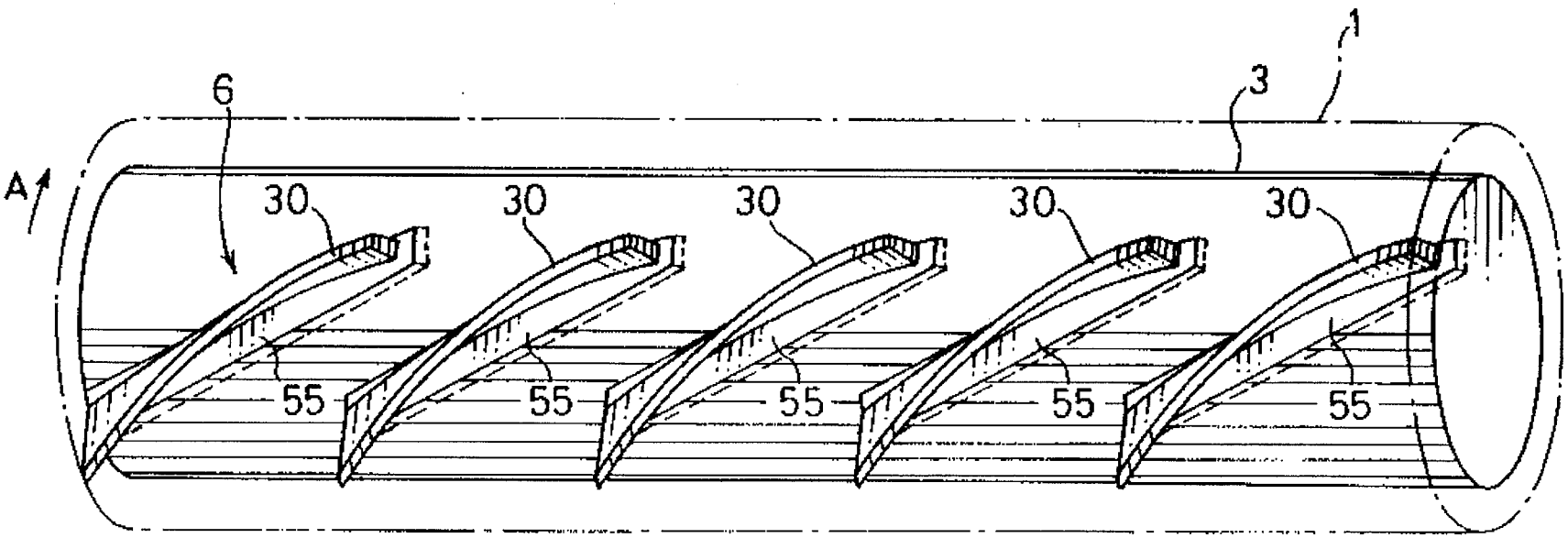
FIG. 22 is a perspective view illustrating the structure of a still another cleaner (modified example) of the image forming apparatus.

The foregoing embodiment deals with the case where each plane in which the blades 30 of the cleaner 6 come into contact with the inner surface of the photoreceptor drum 1 with an angle with respect to a counterclockwise direction as illustrated in FIG. 4. However, as illustrated in Fig. 21 for instance, each plane, in which the blades 30 of the cleaner 6 come into contact with the inner surface of the photoreceptor drum 1, may be at right angle. The foregoing embodiment deals with the case where the cross sectional shape of the blade 30 is configured like a trapezoid so that the thickness on the blade holder 7 side is thicker than that on the contacting surface. However, the cross sectional shape of the blade 30 may be of substantially a rectangular so that the thickness on the blade holder 7 side is equal to that on the contacting surface. The cleaner 6 may have a plurality of blade holders 55, as illustrated in FIG. 22 for instance, instead of the blade holder 7. In such a case, each blade 30 is fixed to the corresponding blade holder 55.

Figure 23:
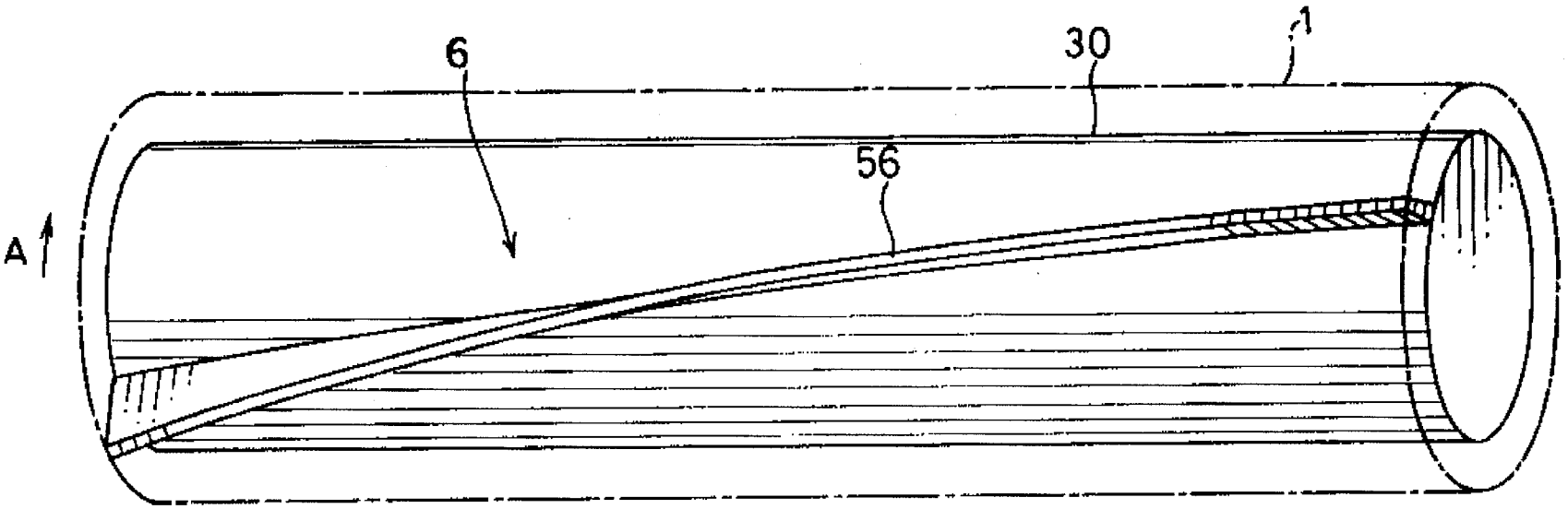
FIG. 23 is a perspective view illustrating the structure of a yet still another cleaner (modified example) of the image forming apparatus.
Figure 24A:
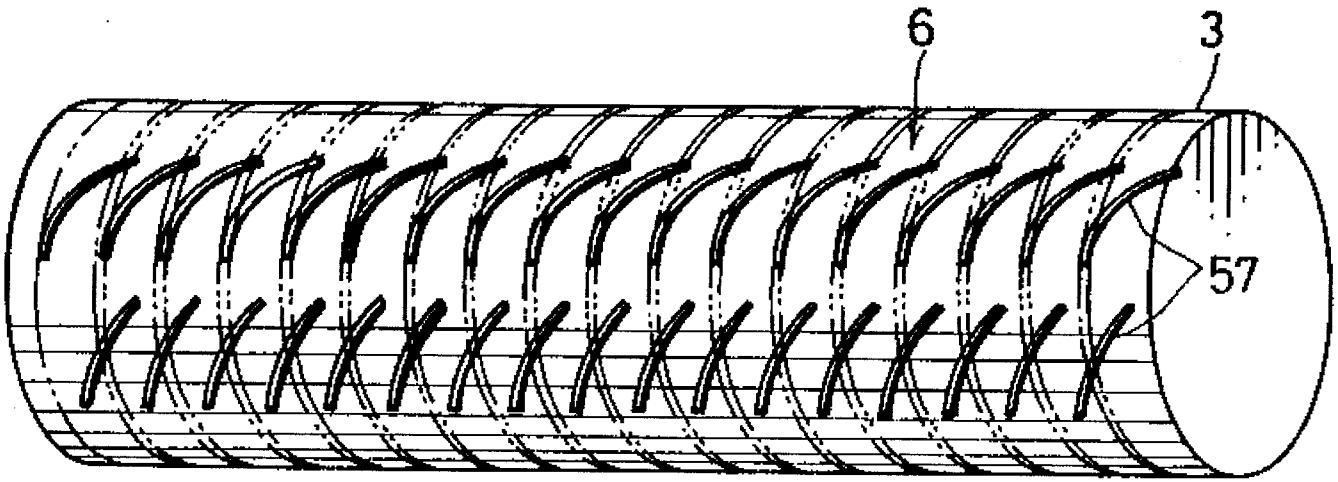
FIGS. 24(*a*) and 24(*b*) are perspective views illustrating the structure of another cleaner (modified example) of the image forming apparatus, FIG. 24(*a*) is a perspective view of the cleaner and FIG. 24(*a*) is a side view of the cleaner.
Figure 24B:
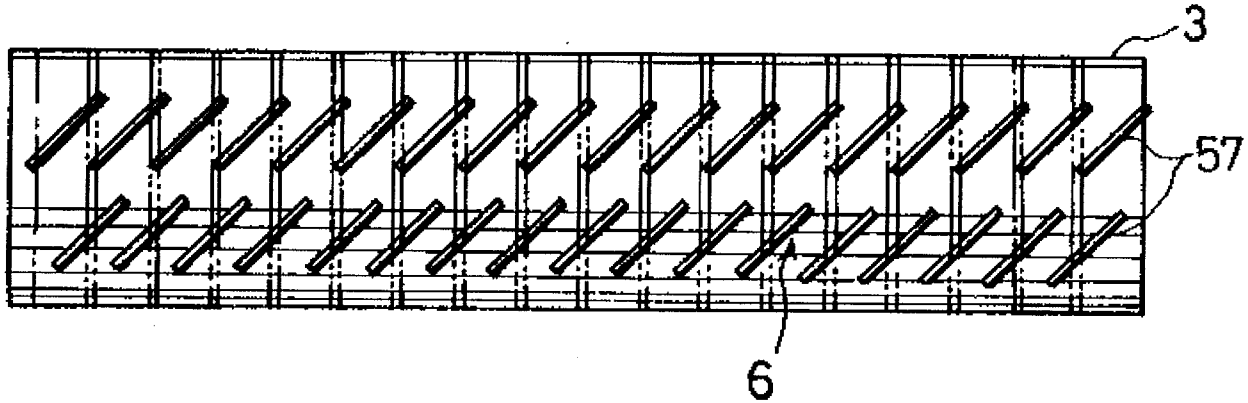

The foregoing embodiment deals with the case where the cleaner 6 is composed of a plurality of blades 30. However, the present invention is not limited to such a case. For instance, the cleaner 6 may be configured as illustrated in FIG. 23 so as to have a single blade 56. The cleaner 6 may be configured as illustrated in FIG. 24 so as to have a plurality of blades 57, each of the blades 57 coming into contact with the inner surface of the photoreceptor drum 1 so that the blades 57 as a whole are provided in a double spiral manner. Such configuration of the blades 57 ensures that the inner surface of the photoreceptor drum 1 is kept more clean. Note that, in the cleaner 6, a material having appropriate elasticity such as a brush made of synthetic resin may be substituted for the foregoing blade. In such a case, the cleaner 6 can remove the contaminated materials on the inner surface of the photoreceptor drum 1 in a similar manner to the foregoing one.

Figures 25A, 25B, 25C:
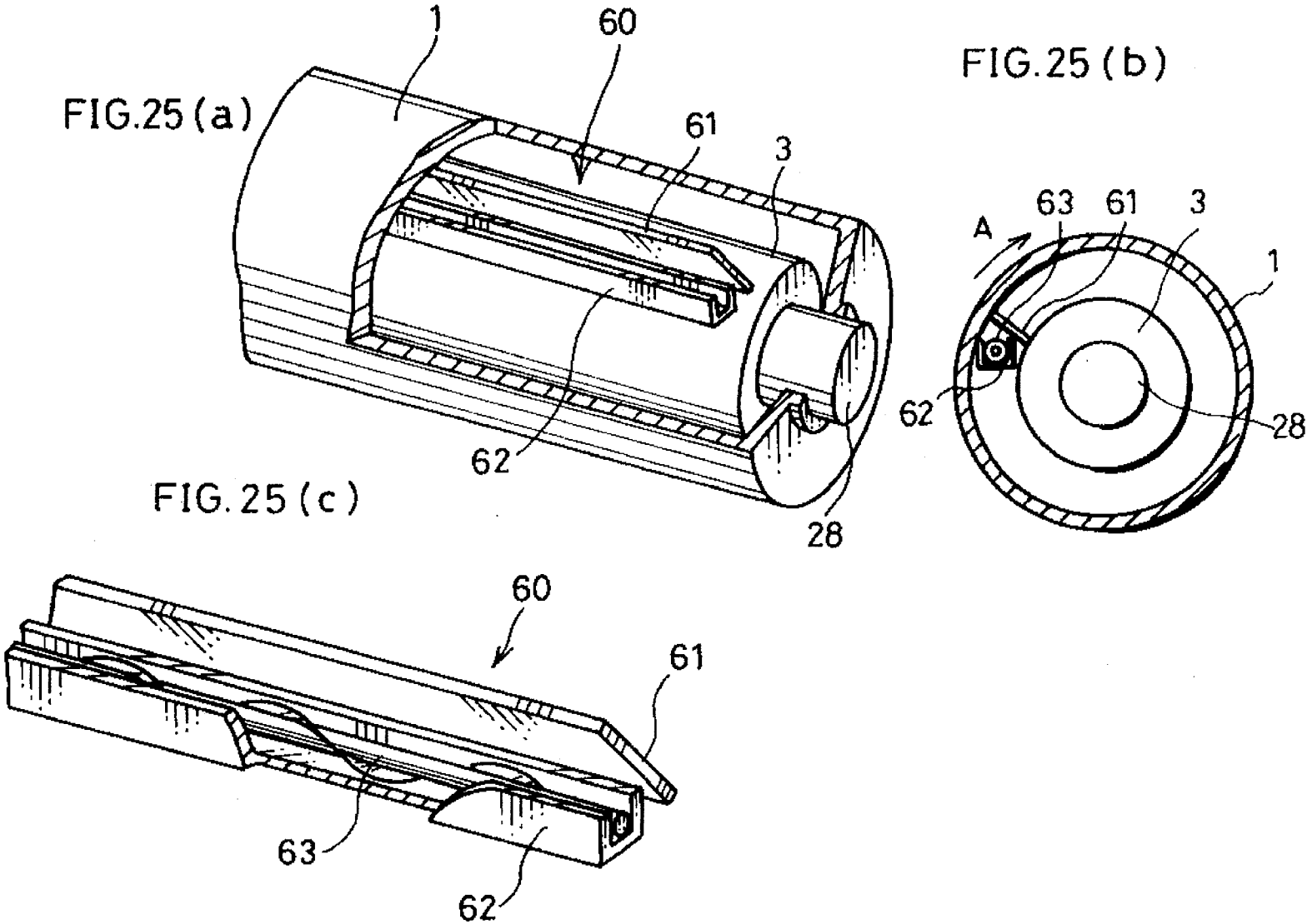
FIGS. 25(*a*) through 25(*c*) are perspective views illustrating the structure of a still another cleaner (modified example) of the image forming apparatus, FIG. 25(*a*) is a perspective view, which is illustrated partially by a sectional view, illustrating the main portion of a unit of the cleaner, FIG. 25(*b*) is a sectional view illustrating the schematic structure of the unit, and FIG. 25(*c*) is a a perspective view, which is illustrated partially by a sectional view, illustrating the main portion of the cleaner.

In the present image forming apparatus, a cleaner 60 of FIGS. 25(*a*) to 25(*c*) may be substituted for the cleaner 6, the cleaner 60 having a blade 61, a receiving member 62 and a transporting member 63 in the receiving member 62. The cleaner 60 is fixed to a predetermined portion of the optical system 3. More specifically, the blade 61 is provided on the optical system 3 parallel to the shaft direction of the photoreceptor drum 1. The receiving member 62 is disposed so as to receive the contaminated materials which have been removed by the blade 61. The transporting member 63 is rotated by a motor (not illustrated), and transports the contaminated materials received by the receiving member 62 in the shaft direction of the photoreceptor drum 1. The cleaner 60 is arranged so that (1) the contaminated materials are removed from the inner surface of the photoreceptor drum 1, (2) the removed contaminated materials are received by the receiving member 62, thereafter (3) the received contaminated materials are transported by the transporting member 63 in the shaft direction of the photoreceptor drum 1. Thus, the cleaner 60, like the cleaner 6, can remove the contaminated materials on the inner surface of the photoreceptor drum 1.

Figure 26:
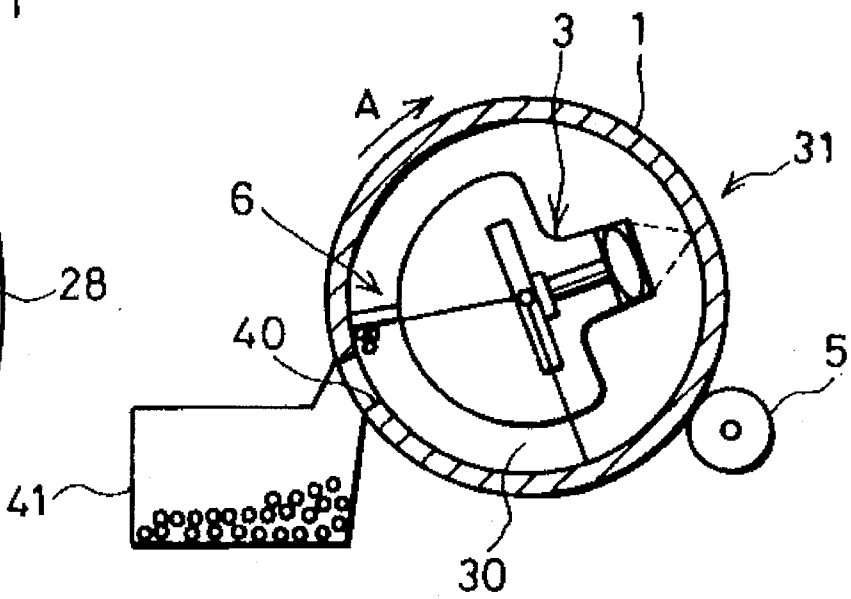
FIGS. 26(*a*) and 26(*b*) are views illustrating the structure of a still another unit (modified example) of the image forming apparatus, FIG. 26(*a*) is a perspective view, which is illustrated partially by a sectional view, illustrating the main portion of the unit, FIG. 26(*b*) is a sectional view illustrating the structure of the main portion of the unit.
Figure 26:
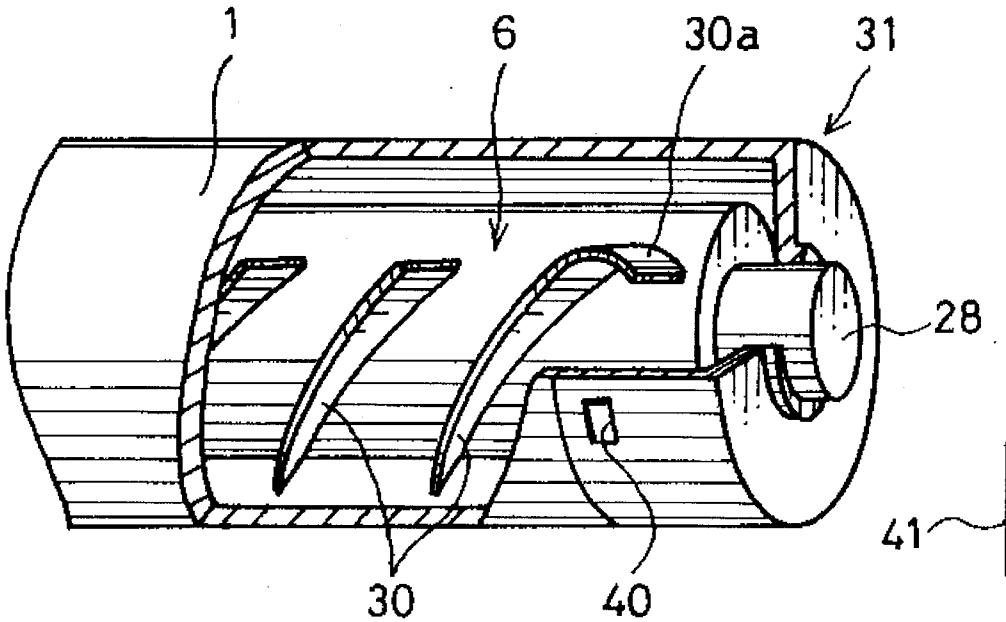

The foregoing embodiment deals with the case where the discharge hole 40 for discharging the contaminated materials outward is provided in one side surface of the photoreceptor drum 1 vertical to the shaft direction thereof in the unit 31. However, a discharge hole 40 may be disposed on the outer surface of the photoreceptor drum 1 as illustrated in FIGS. 26(*a*) and 26(*b*). More specifically, the discharge hole 40 is provided in the portion corresponding to the lowest part 30*a* of the lowest blade 30 in the transporting direction of the contaminated materials (in substantially the right direction of FIG. 26(*a*)). The lowest part 30*a* of the blade 30 is formed so that the extended line of the lowest part 30*a* is bent in a spiral manner whose direction is reverse to that of the entire blades 30, thereby resulting in that the lowest part 30*a* can discharge the contaminated materials outward through the discharge hole 40. In such an arrangement, when the discharge hole 40 has just reached the lowest part 30*a* of the blade 30 in accordance with the rotation of the photoreceptor drum 1, the contaminated materials are discharged from the lowest part 30*a* of the blade 30 to the abolition bottle 41 through the discharge hole 40.

A stopper 65 is preferably provided in a predetermined portion of the unit 31 so that the lid 47 (see FIG. 14) of the unit 31 is not carelessly opened (see FIG. 27 for instance) during the attaching or detaching of the unit 31. The stopper 65 has substantially a trapezoid shape, and is slidably provided with respect to the unit 31.

Figure 27B:
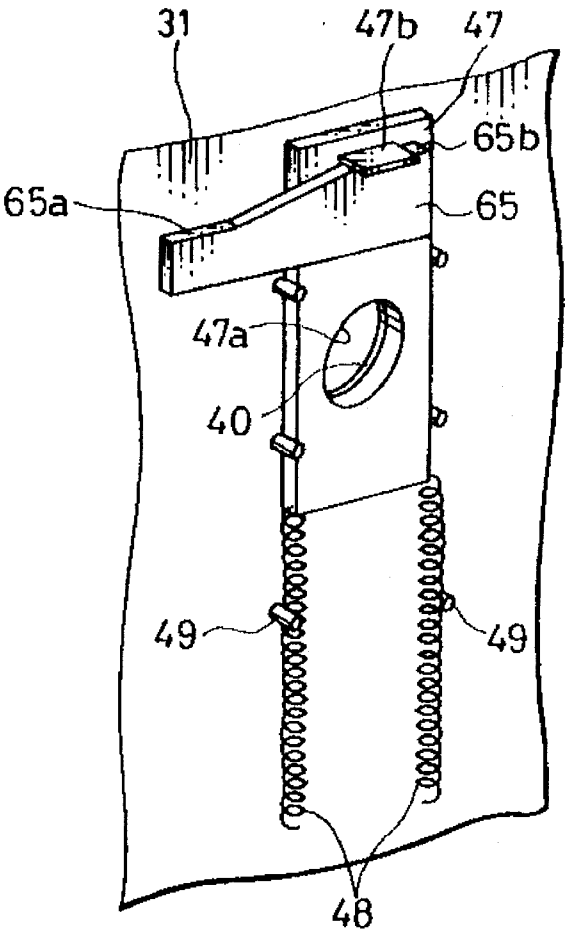
FIGS. 27(*a*) and 27(*b*) illustrate the structure of another collecting means (modified example) of the unit and also are perspective views illustrating the main portion of the collecting means.
Figure 27A:
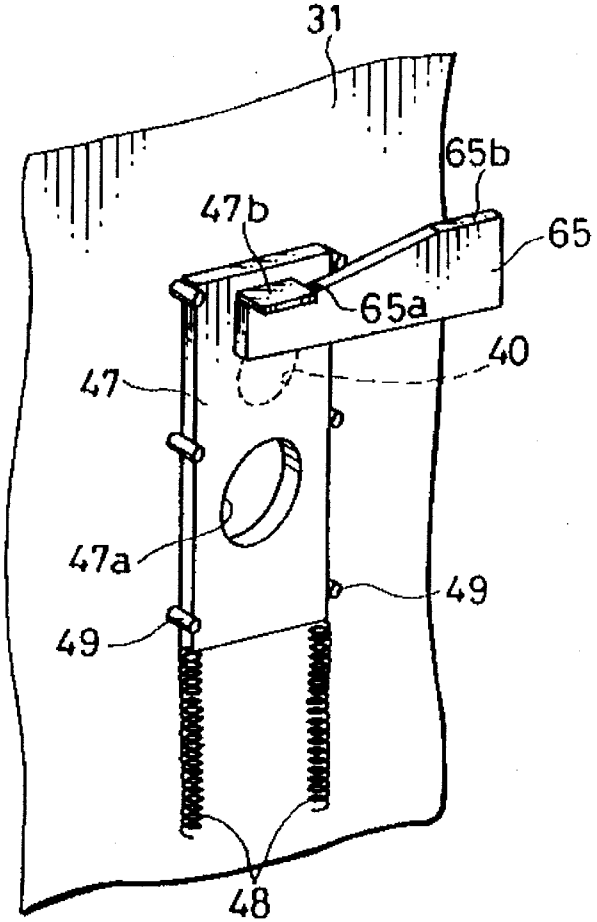
Figure 28:
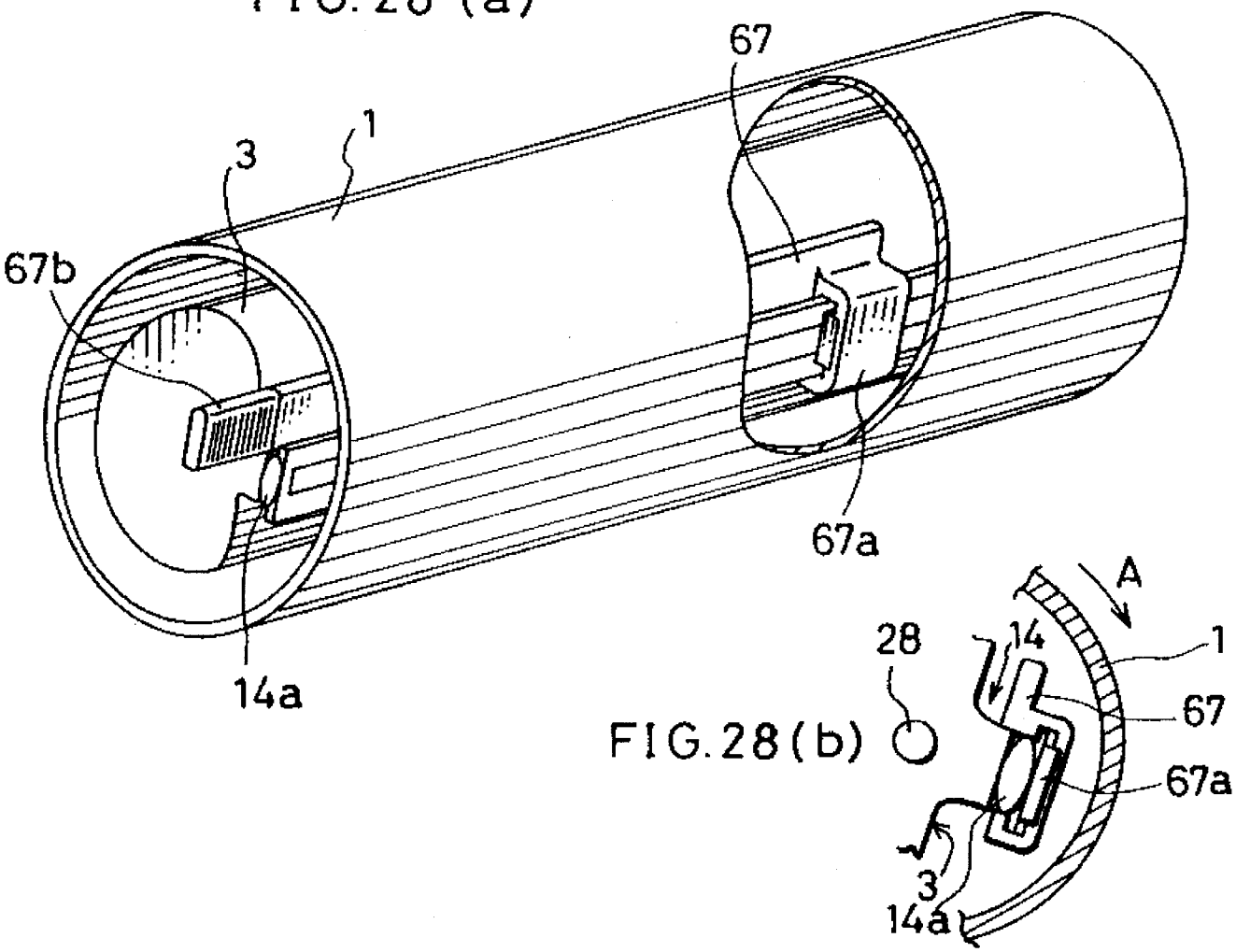
FIGS. 28(*a*) and 28(*b*) are illustrate the structure of a still another unit (modified example) of the image forming apparatus, FIG. 28(*a*) is a perspective view, which is illustrated partially by a sectional view, illustrating the main portion of the unit, FIG. 28(*b*) is a sectional view illustrating the main portion of the unit.

A tension due to a spring (not illustrated) always exterts the stopper 65 to move in the right direction of FIG. 27. When the attaching or detaching of the unit 31, as illustrated in FIG. 27(*a*), a top surface 65*a* of the stopper 65 comes into contact with the projection section 47*b* since the tension due to the spring has exterted the stopper 65 to move in the right direction. Thus, the lid 47 covers the discharge hole 40. In contrast, when the abolition bottle 41 (see FIG. 13) is attached, as illustrated in FIG. 27(*b*), the stopper 65 is pushed upward by the top section 42*b* of the abolition bottle 41 so as to slide in substantially the left direction. So, the top surface 65*b* of the stopper 65 pushes upward the projection section 47*b* of the lid 47, thereby making the discharge hole 40 open.

The foregoing embodiment deals with the case where the protection members 34 for protecting the short focal distance lens 14*a* from the contaminated materials are provided in the top portion of the LED array 14 in the optical system (see FIG. 10). However, the present invention is not limited to this case, i.e., a lens cleaner 67 for cleaning the surface of the short focal distance lens 14*a* may be provided in a predetermined portion of the optical system 3 (see for instance FIG. 28) instead of the protection members 34. The lens cleaner 67 is composed of a cleaning member 67*a*, which comes into contact with the short focal distance lens 14*a*, for scraping off the surface of the short focal distance lens 14*a*, and a handle 67*b* for sliding the cleaning member 67*a* in the shaft direction of the photoreceptor drum 1. The cleaning member 67*a* is made of the materials which do not damage the short focal distance lens 14*a* such as non woven fabric. When the user of the apparatus slides the handle 67*b* in the shaft direction of the photoreceptor drum 1 in accordance with the need, the cleaning member 67*a* scrapes off the surface of the short focal distance lens 14*a*. Thus, the surface of the short focal distance lens 14*a* is kept clean, thereby avoiding that the exposure or other procedure is not appropriately carried out with respect to the photoreceptor drum 1.

The image forming apparatus in accordance with the present invention is suitable for the business machines such as a copying machine, a facsimile machine, a printer, an optical printer. Since the present image forming apparatus is the so-called rear exposure type in which the image exposure is carried out on the inner surface side of the photoreceptor, the charger such as the Corona charger for charging the photoreceptor surface is not required. Accordingly, it never occurs that the ozone is generated. Furhter, since the exposure means is provided in the photoreceptor, the size of the entire apparatus can be reduced.

The following description deals with another embodiment of the present invention with reference to FIGS. 29 through 33. For convenience, the member which have the same function as that of the foregoing first embodiment is denoted as the same reference numeral, and the detail explanations thereof are omitted.

Figure 29:
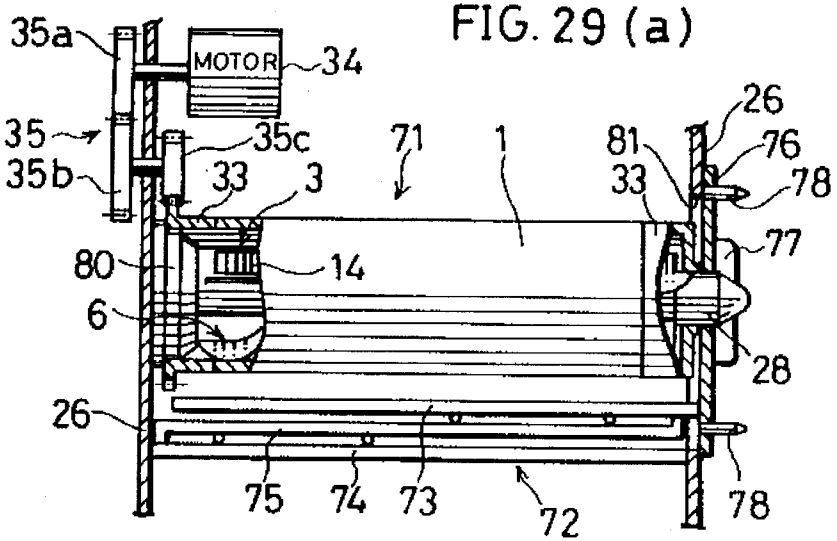
FIGS. 29(*a*) and 29(*b*) are schematic sectional views illustrating the main portion of an image forming apparatus in accordance with another embodiment of the present invention.
Figure 29:
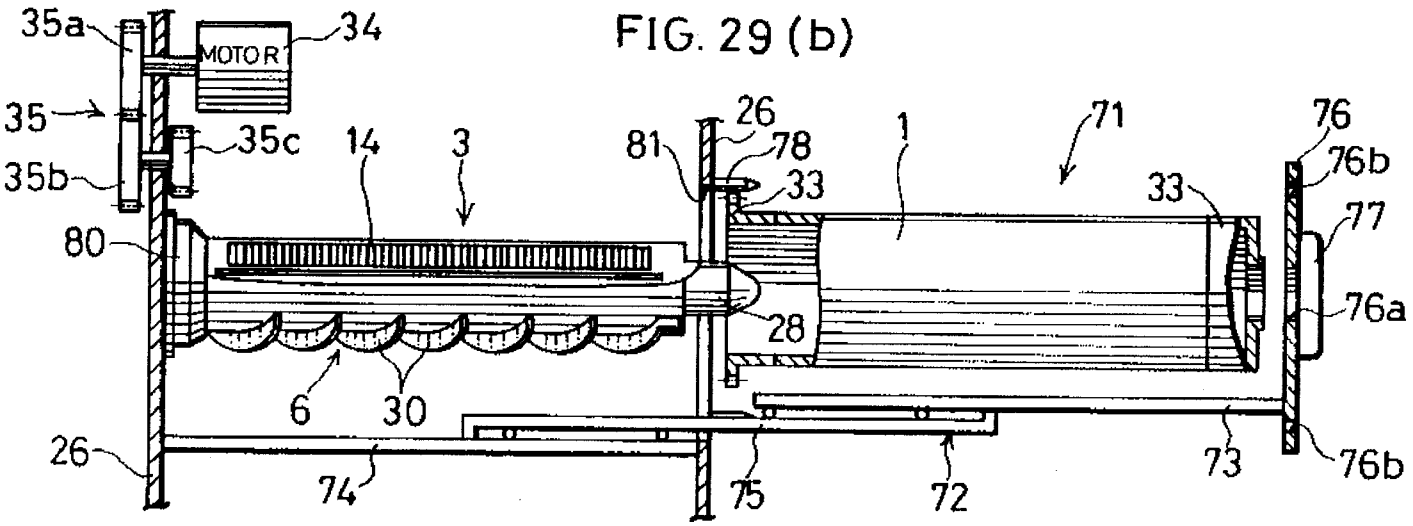

According to an image forming apparatus of the present embodiment, a unit 71 having a photoreceptor drum 1 (photosensitive body) and a driving member 33 attached to the photoreceptor drum 1 is substituted for the foregoing unit 31 having the photoreceptor drum 1, the optical system 3 and the cleaner 6 (see FIGS. 29(*a*) and 30(*a*)). There is provided a moving device 72 (photoreceptor attaching means), in an image forming apparatus main body 26 near the unit 71, for moving the unit 71 in a shaft direction of the photoreceptor drum 1. An optical system 3 and a cleaner 6 are fixed to the image forming apparatus main body 26 through a fixing member 80 so as to be positioned with accuracy. The image forming apparatus main body 26 is provided with an opening section 81 through which the unit 71 can move in the shaft direction of the photoreceptor drum 1 (later described).

Figure 31A:
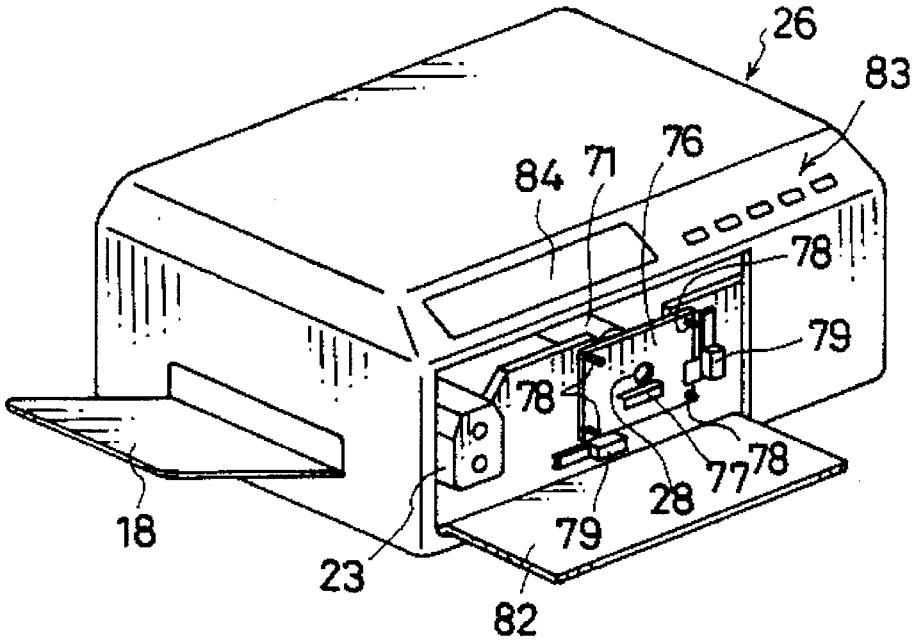
FIGS. 31(*a*) and 31(*b*) are schematic perspective views illustrating the image forming apparatus of FIGS. 29(*a*) and 29(*b*).
Figure 31:
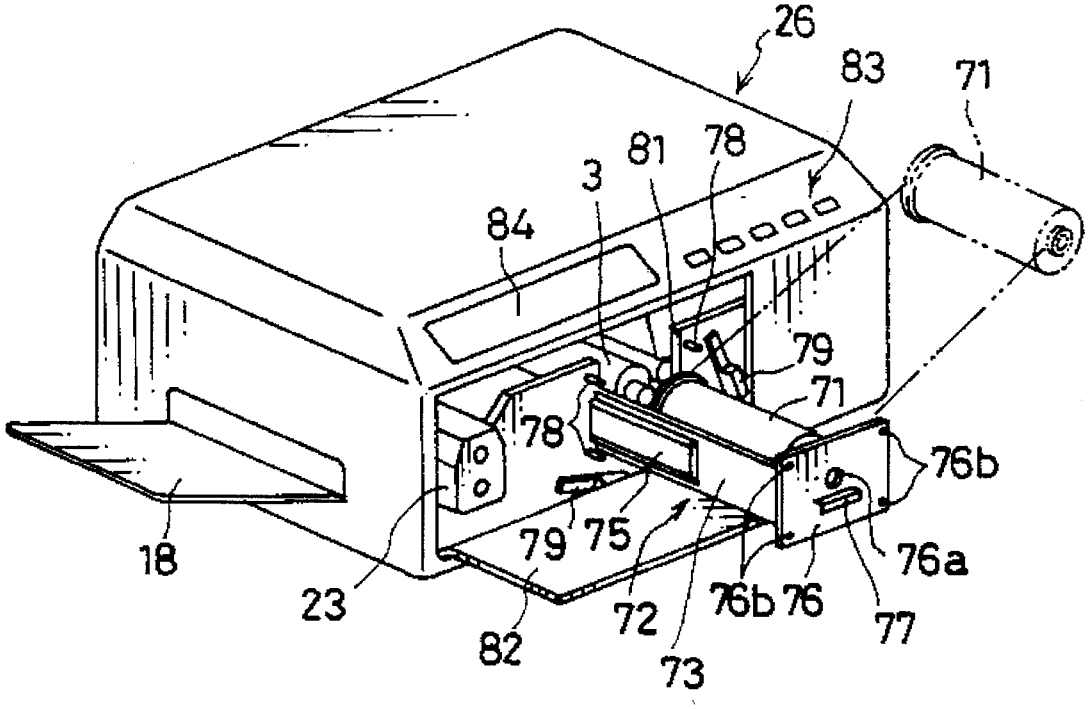
Figure 32:
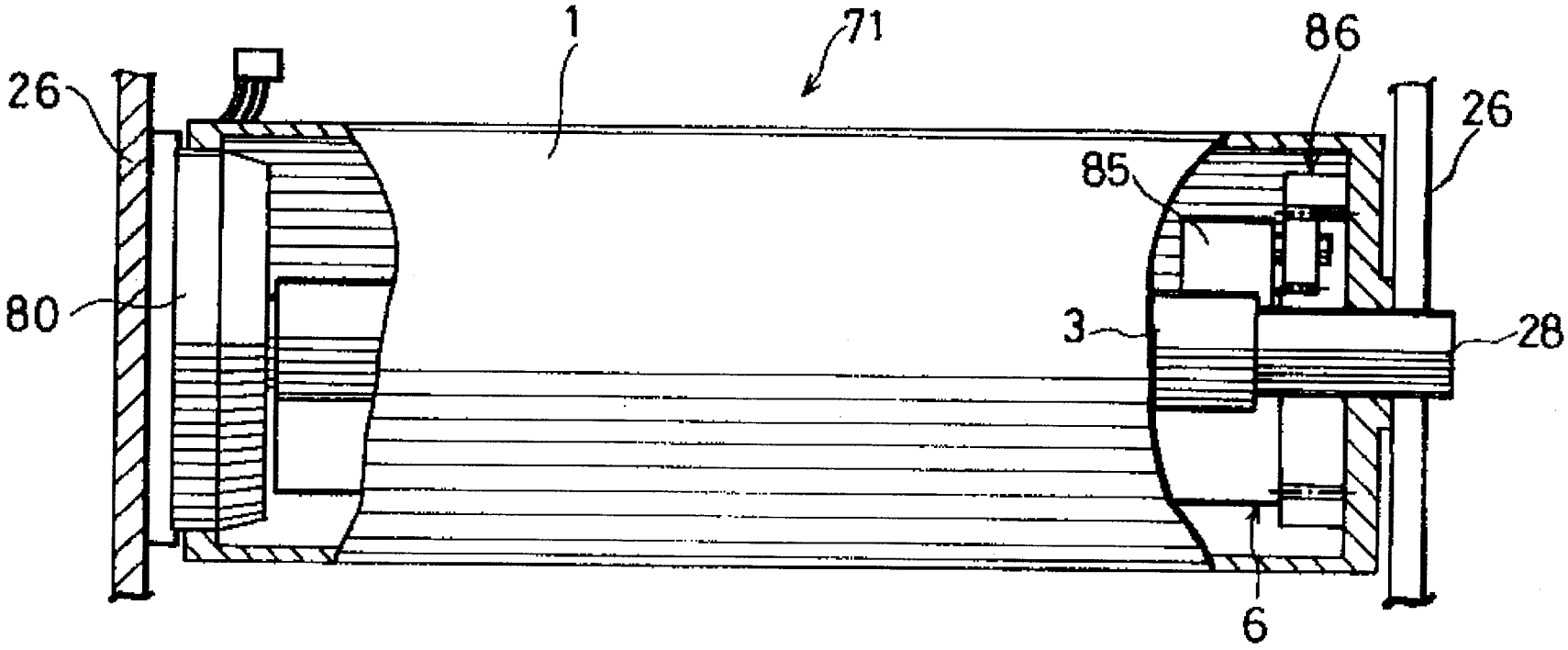
FIG. 32 is a schematic sectional views illustrating the structure of another unit (modified example) of the image forming apparatus of FIGS. 29(*a*) and 29(*b*).

The image forming apparatus of the present embodiment is provided with a side lid 82 on the side wall of the image forming apparatus main body 26 which is substituted for the foregoing upper lid 27 (see FIG. 31). The side lid 82 is opened during attaching or detaching of the unit 71 (later described), while it is ordinarily closed. An upper surface of the image forming apparatus main body 26 is provided with an operation panel 83 and display device 84. The operation panel 83 has keys such as a ten-key for setting the number to be printed and reduction/enlargement ratio and a print start key. The display device 84 displays the error when some errors occur due to the image forming apparatus main body.

The moving device 72, as illustrated in FIGS. 29(*b*) and 30(*b*), is composed of a supporting member 73 for supporting the unit 71, an attaching member 74 for attaching the main body of the moving device 72 to the image forming apparatus main body 26, a connecting member 75 for connecting the supporting member 73 with the attaching member 74 and a positioning member 76 fixed to the supporting member 73. The connecting member 75 is provided with respect to the attaching member 74 so as to be slidable in the shaft direction of the photoreceptor drum 1. The supporting member 73 is provided with respect to the connecting member 75 so as to be slidable in the shaft direction of the photoreceptor drum 1.

The supporting member 73 has plates 73*a* for placing the unit 71 on a predetermined position and a guide section 73*b* for moving the unit 71 in the shaft direction of the photoreceptor drum 1.

The positioning member 76 has a shape and size so as to cover the opening section 81 of the image forming apparatus main body 26. The front surface of the positioning member 76 is provided with a handle 77 for taking out the unit 71, and is also provided with a shaft bearing hole 76*a* and positioning holes 76*b*. The shaft bearing hole 76*a* is formed so that a fixing shaft 28 (photoreceptor attaching means) of the optical system 3 is inset in the shaft bearing hole 76*a* when the unit 71 is positioned by action of moving in the left direction of FIG. 30(*b*). The positioning holes 76*b* are formed in the four (4) corners of the positioning member 76. The positioning pins 78 are provided at the positions of the image forming apparatus main body 26 which correspond to respective positioning holes 76*b*. Each positioning pin 78 passes through the corresponding positioning hole 76*b* when the unit 71 is moved and positioned. Accordingly, the guide section 73 (the unit 71) is positioned.

As illustrated in FIG. 31, stoppers 79 are provided around the opening section 81 of the image forming apparatus main body 26 for fixing the positioning member 76 (i.e., the unit 71) so that the unit 71 is not carelessly taken out. The stoppers 79 are manually operated. Other structure in the present image forming apparatus is the same as that of the foregoing first embodiment.

The moving device 72 causes the unit 71 to move from the position as illustrated in FIGS. 29(*a*), 30(*a*) and 31(*a*) to the position as illustrated in FIGS. 29(*b*), 30(*b*) and 31(*b*) during the attachment and detachment of the unit 71. The moving device 72 is arranged so that when the handle 77 is taken out in the right direction of FIGS. 29 and 30, the supporting member 73 and the connecting member 75, which are in the image forming apparatus main body 26 so as to be piled with each other, slide in the right direction. With the arrangement, the unit 71 in the image forming apparatus main body 26 can be taken out through the opening section 81 of the image forming apparatus main body 26.

Figure 30A:
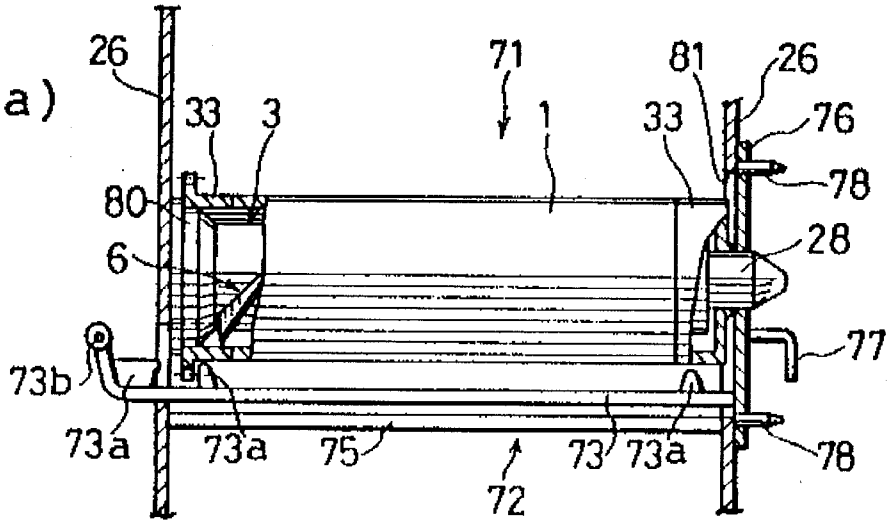
FIGS. 30(*a*) and 30 (*b*) are schematic sectional views illustrating the main portion of the image forming apparatus of FIGS. 29(*a*) and 29(*b*).
Figure 30B:
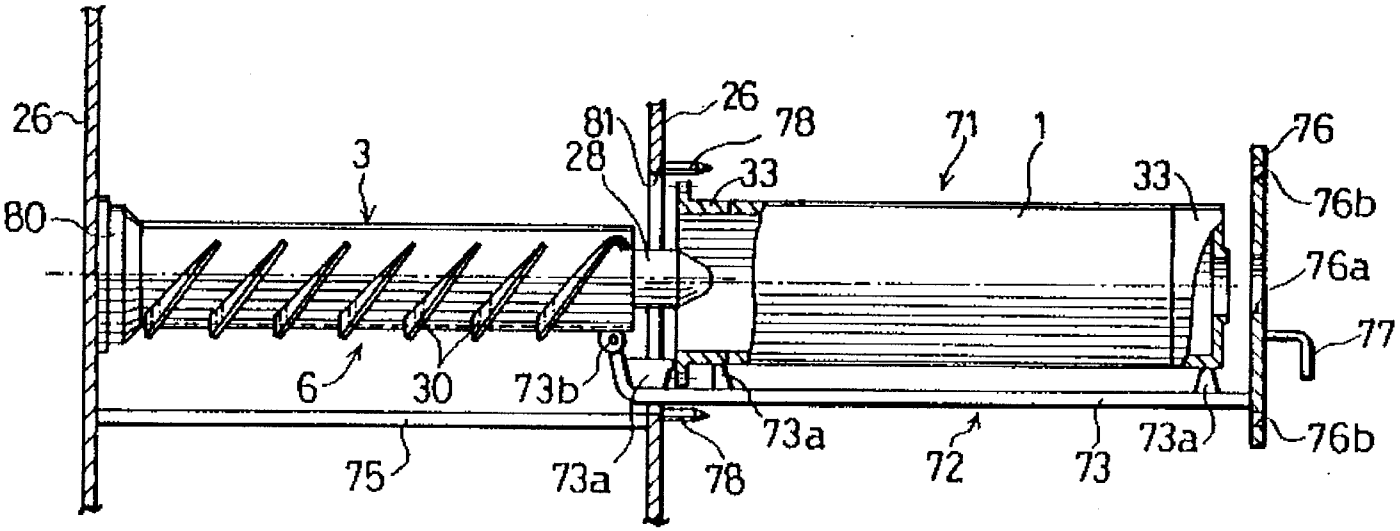

During the taking out of the unit 71, the unit 71 is never caught by the blades 30 of the cleaner 6 based on the fact that the supporting member 73 slightly moves the unit 71 in a direction where the unit 71 is away from the cleaner 6, i.e., downward in FIG. 30(*b*) in accordance with the guiding of a guide section 73*b*, thereafter moves the unit 71 in the shaft direction of the photoreceptor drum 1. Accordingly, the supporting member 73 moves the unit 71 so that the central line of the fixing shaft 28 (the optical system 3) slightly deviates from the central line of the photoreceptor drum 1 (the unit 71) as the alternate long and dashed line illustrated in FIG. 30(*b*). The unit 71 which has been taken out is removed from the supporting member 73 as the alternate long and two-dashed line illustrated in FIG. 31(*b*). The guide section 73*b* of the supporting member 73 has also the function for supporting the optical system 3 so as to avoid that only one end of the optical system 3 is supported when the unit 71 has been taken out.

The unit 71 can be returned into the image forming apparatus main body 26 by carrying out the reverse procedures i.e., by pushing the handle 77 in the left direction of FIGS. 29 and 30. Thus, the unit 71 can be attached to and removed from the image forming apparatus main body 26, so the unit 71 can be replaced when the photoreceptor drum 1 deteriorates for instance. Further, since the fixing shaft 28 passes through the shaft bearing hole 76*a* and each positioning pin 78 passes through the corresponding positioning hole 76*b*, the unit 71 can be appropriately placed in the predetermined position of the image forming apparatus main body 26 with accuracy without fine adjusting treatments such as the positioning.

The present embodiment is not limited to the foregoing moving device 72 provided that it is arranged such that the unit 71 is movable with respect to the shaft direction of the photoreceptor drum 1.

The image forming apparatus of the present embodiment, as mentioned above, is arranged so that the optical system 3 is fixed to the image forming apparatus main body 26, the unit 71 composed of the photoreceptor drum 1 and the driving member 33 is attached to the image forming apparatus main body 26 through the photoreceptor attaching means composed of the moving device 72 and the fixing shaft 28, and the photoreceptor attaching means is attachably and detachably provided with respect to the image forming apparatus main body 26.

With the arrangement, the same functions and effects can be achieved as those of the foregoing first embodiment. More specifically, the attachment and detachment of the unit 71 (the photoreceptor drum 1) with respect to the image forming apparatus main body 26 can be made at the user's end, thereby resulting in that the replacement of the photoreceptor drum 1 with a new one can be made at the user's end with ease. Thus, it is possible to provide the image forming apparatus which is excellent in the operations such as the maintenance. Note that the optical system 3 is not replaced during the replacement of the photoreceptor drum 1 as the unit 71, so it is possible to reduce the replacement cost. Further, the unit 71 is moved by the moving device 72 to the shaft direction of the photoreceptor drum 1, so it is easier to attach and detach the unit 71 with respect to the image forming apparatus main body 26.

The foregoing embodiment deals with the case where the motor 34 for driving the photoreceptor drum 1 is provided in the predetermined position of the image forming apparatus main body 26 as illustrated in FIGS. 29 and 30.

However, the present invention is not limited to this arrangement, i.e., the motor for driving the photoreceptor drum 1 so as to rotate may be provided on the inner surface side of the photoreceptor drum 1. More specifically, the arrangement of FIG. 32 may be substituted. Namely, a motor 85 is provided in the unit 71 for driving the photoreceptor drum 1 so as to rotate. The driving force is transmitted to the photoreceptor drum 1 through gears 86 composed of helical gears having an engagement ratio of not less than 1, thereby resulting in that the photoreceptor drum 1 rotates. The engagement ratio of the gears 86 is set such that the photoreceptor drum 1 rotates slower than the motor 86.

Figure 33:
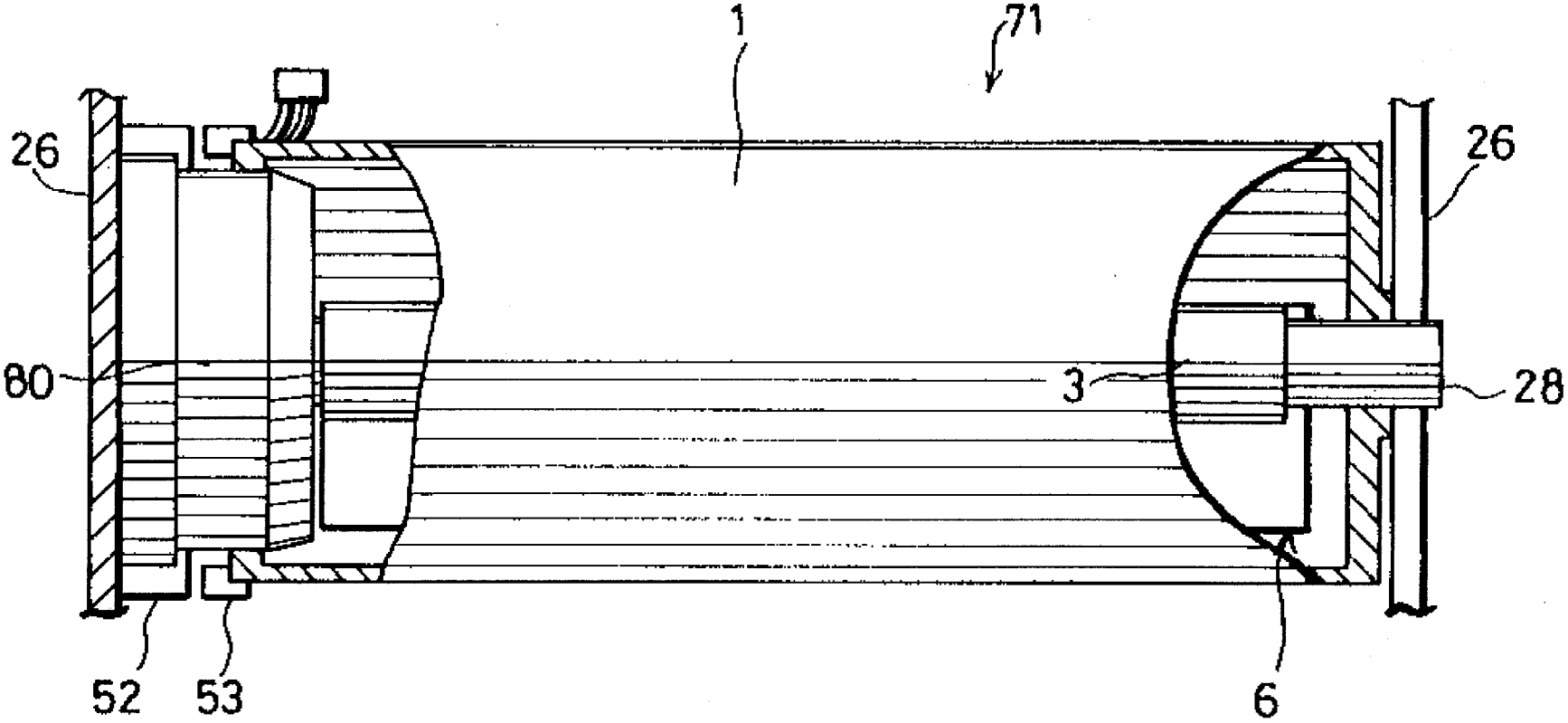
FIG. 33 is a schematic sectional views illustrating a still another unit (modified example) of the image forming apparatus of FIGS. 29(*a*) and 29(*b*).
Figure 34:
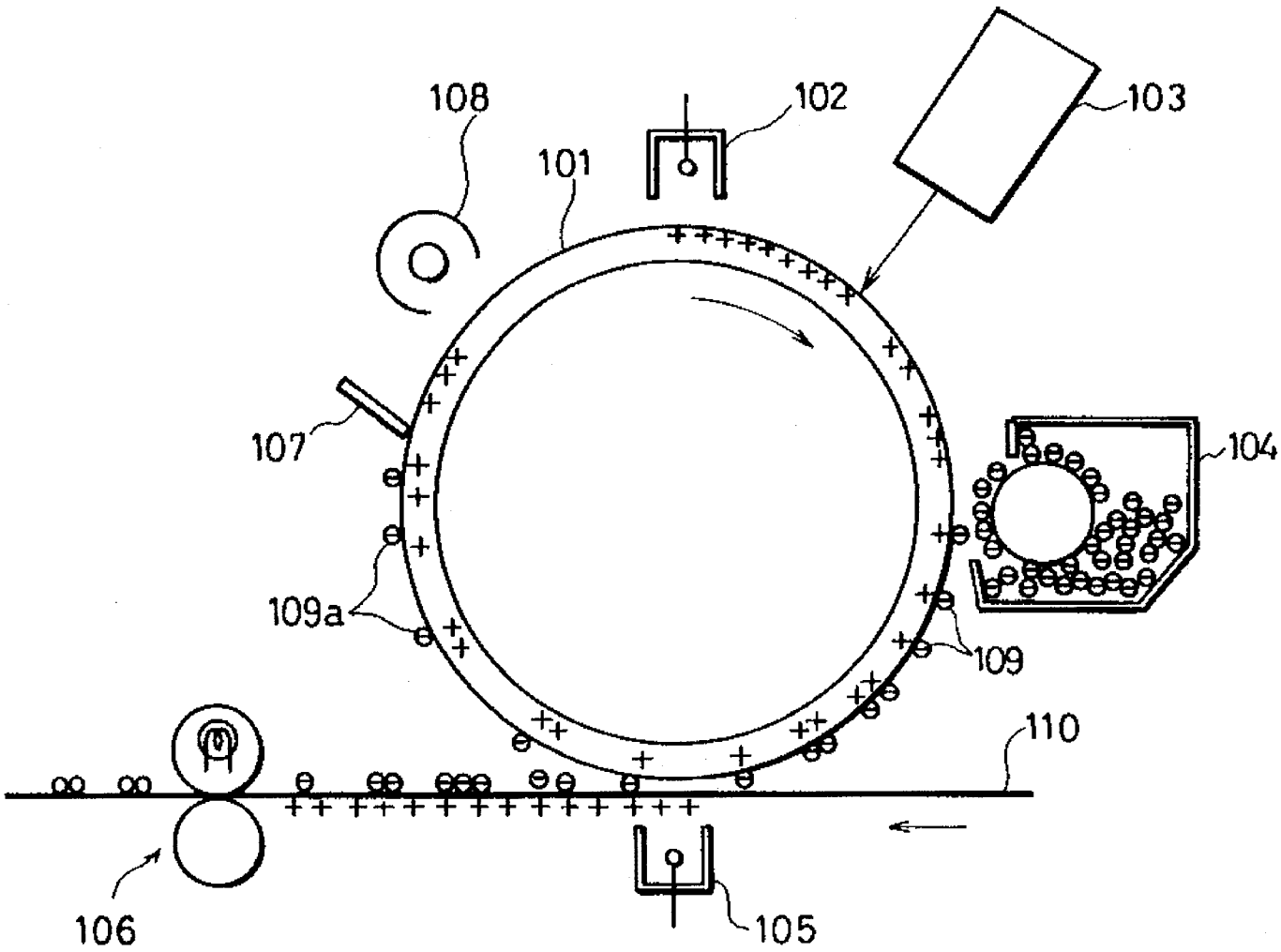
FIG. 34 is an explanatory views illustrating how a toner image is formed on the surface of a photoreceptor drum of a conventional image forming apparatus.

As illustrated in FIG. 33, the following arrangement, wherein a stator 52 is provided in the image forming apparatus main body 26 while a rotor 53 is provided in correspondence with the stator 52 in the shaft direction of the photoreceptor drum 1, may be substituted for the arrangement wherein the photoreceptor drum 1 is rotated by the motor. With the arrangement, the electromagnetic force exerted between the stator 52 and the rotor 53 drives the photoreceptor drum 1 so as to rotate.

The first image forming apparatus of the present invention, as mentioned above, having:

a photoreceptor on which a transparent conductive layer and a photoconductive layer are luminated in this order on the outer surface of a substrate; and exposure means, provided on the inner surface side of the photoreceptor, for exposing the photoreceptor, is characterised in that the photoreceptor and the exposure means are attached to the image forming apparatus main body through attaching means which is attachably and detachably provided with respect to the image forming apparatus main body.

With the arrangement, the photoreceptor and the exposure means are attached to the image forming apparatus main body through attaching means which is attachably and detachably provided with respect to the image forming apparatus main body. So, the attachment and detachment of the photoreceptor with respect to the image forming apparatus main body can be made at the user's end with ease.

The positional relation between the photoreceptor and the exposure means is always kept constant by the attaching means. Namely, the high accuracy of the positions where the photoreceptor and the exposure means are attached with respect to the image forming apparatus main body is always kept.

Thus, since it is not required that the further fine adjustments for positioning for the attachment are carried out at the user's end, the replacement of the photoreceptor does not need the professional skill. Therefore, it is possible to provide an image forming apparatus in which the operations such as the maintenance can be effectively made.

The second image forming apparatus of the present invention, as mentioned above, having:

a photoreceptor on which a transparent conductive layer and a photoconductive layer are luminated in this order on the outer surface of a substrate; and exposure means, provided on the inner surface side of the photoreceptor, for exposing the photoreceptor, is characterised in that the exposure means is fixed to the image forming apparatus main body and in that the photoreceptor is attached to the image forming apparatus main body through photoreceptor attaching means which is attachably and detachably provided with respect to the image forming apparatus main body.

With the arrangement, the exposure means is fixed to the image forming apparatus main body and the photoreceptor is attached to the image forming apparatus main body through photoreceptor attaching means which is attachably and detachably provided with respect to the image forming apparatus main body.

So, the attachment and detachment of the photoreceptor with respect to the image forming apparatus main body can be made at the user's end with ease. Therefore, it is possible to provide an image forming apparatus in which the operations such as the maintenance can be effectively made.

The third image forming apparatus of the present invention, as mentioned above, having:

a photoreceptor on which a transparent conductive layer and a photoconductive layer are luminated in this order on the outer surface of a substrate; and exposure means, provided on the inner surface side of the photoreceptor, for exposing the photoreceptor, is characterised in that the photoreceptor and the exposure means are attached to the image forming apparatus main body through attaching means which is attachably and detachably provided with respect to the image forming apparatus main body, and in that removing means for removing contaminated materials on the inner surface of the photoreceptor is provided on the inner surface side of the photoreceptor.

With the arrangement, the photoreceptor and the exposure means are attached to the image forming apparatus main body through attaching means which is attachably and detachably provided with respect to the image forming apparatus main body, and the removing means for removing contaminated materials on the inner surface of the photoreceptor is provided on the inner surface side of the photoreceptor. So, the attachment and detachment of the photoreceptor with respect to the image forming apparatus main body can be made at the user's end with ease. The positional relation between the photoreceptor and the exposure means is always kept constant by the attaching means. Namely, the high accuracy of the positions where the photoreceptor and the exposure means are attached with respect to the image forming apparatus main body is always kept. Thus, since it is not required that the further fine adjustments for positioning for attachment are carried out at the user's end, the replacement of the photoreceptor does not need the professional skill. Therefore, it is possible to provide an image forming apparatus in which the operations such as the maintenance can be effectively made.

In addition, when the contaminated materials such as toners come into the inside of the photoreceptor, the contaminated materials can be removed. This ensures that the exposure of the photoreceptor is appropriately carried out, thereby making it possible to provide an image forming apparatus in which the operations such as the maintenance can be effectively made.

The fourth image forming apparatus of the present invention, as mentioned above, having:

a photoreceptor on which a transparent conductive layer and a photoconductive layer are luminated in this order on the outer surface of a substrate; and exposure means, provided on the inner surface side of the photoreceptor, for exposing the photoreceptor is characterised in that (1) the exposure means is fixed to the image forming apparatus main body, (2) the photoreceptor is attached to the image forming apparatus main body through photoreceptor attaching means which is attachably and detachably provided with respect to the image forming apparatus main body, and (3) removing means for removing contaminated materials on the inner surface of the photoreceptor is provided on the inner surface side of the photoreceptor.

With the arrangement, the exposure means is fixed to the image forming apparatus main body, the photoreceptor is attached to the image forming apparatus main body through the photoreceptor attaching means which is attachably and detachably provided with respect to the image forming apparatus main body and the removing means for removing contaminated materials on the inner surface of the photoreceptor is provided on the inner surface side of the photoreceptor. So, the attachment and detachment of the photoreceptor with respect to the image forming apparatus main body can be made at the user's end with ease.

In addition, when the contaminated materials such as toners come into the inside of the photoreceptor, the contaminated materials can be removed. This ensures that the exposure of the photoreceptor is appropriately carried out, thereby making it possible to provide an image forming apparatus in which the operations such as the maintenance can be effectively made.

The fifth image forming apparatus of the present invention, as mentioned above, is characterised in that the removing means recited in the third or fourth image forming apparatus is provided so as to contact the inner surface of the photoreceptor in a spiral manner so that the removing means can transport the contaminated materials in the shaft direction of the photoreceptor in accordance with the rotation of the photoreceptor.

With the arrangement, the removing means recited in the third or fourth image forming apparatus is provided so as to contact the inner surface of the photoreceptor in a spiral manner so that the removing means can transport the contaminated materials in the shaft direction of the photoreceptor in accordance with the rotation of the photoreceptor. So, the contaminated materials can be transported in the shaft direction of the photoreceptor without separate transporting means, and it is easier to abolish the contaminated materials from the photoreceptor since the transported contaminated materials are collected in the shaft direction of the photoreceptor.

There are described above novel features which the skilled man will appreciate give rise to advantages. These are each independent aspects of the invention to be covered by the present application, irrespective of whether or not they are included within the scope of the following claims.

What is claimed is:

1. An image forming apparatus comprising:

an image forming apparatus main body; and a unit having a photoreceptor and exposure means for exposing said photoreceptor, said photoreceptor and said exposure means having a predetermined relative positional relation, said photoreceptor being rotatably provided in said unit, being made of a transparent material, and having a cylindrical shade, said exposure means being provided on a side of an inner side surface of said photoreceptor, and said unit itself being attachable and detachable with respect to said image forming apparatus main body during replacement of said unit.

2. An image forming apparatus as set forth in claim 1, further comprising:

a supporting member for supporting said exposure means; and a holding member, provided on a side of said image forming apparatus main body, for holding respective end parts of said supporting member, whereby said unit is attached to and taken out from said image forming apparatus through said supporting member and said holding member.

3. An image forming apparatus as set forth in claim 1, further comprising:

a supporting shaft for supporting said exposure means therearound; and recess parts, provided on a side of said image forming apparatus main body, for bearing respective end parts of said supporting shaft, wherein said unit is attached to and taken out from said image forming apparatus through said supporting shaft and said recess parts, thereby ensuring that positioning of said unit, with respect to said image forming apparatus, is carried out with accuracy.

4. An image forming apparatus as set forth in claim 3, further comprising:

first and second fixing members provided around the respective end parts of said supporting shaft; and an elastic member, said first fixing member being slidably provided in a shaft direction of said supporting shaft, the elastic member applying force to said first fixing member so that said first fixing member keeps away from said exposure means, and said second fixing member being fixed to said exposure means, whereby said first fixing member is pressed against said image forming apparatus main body when said unit is attached to said image forming apparatus main body.

5. An image forming apparatus as set forth in claim 4, further comprising:

driving force generating means for generating driving force for rotating said photoreceptor;

driving force transmitting means for transmitting the driving force;

first and second bearing members, provided around said first and second fixing members respectively, for respectively rotating said photoreceptor therearound; and driving means, provided on a side of unit side, for rotating said photoreceptor in accordance with the transmitted force.

6. The image forming apparatus as set forth in claim wherein said driving force transmitting means includes a plurality of gears having an engagement ratio of not less than 1, and each gear ratio of the gears is set so that a rotation number of said photoreceptor is less than that of said driving force generating means.

7. An image forming apparatus as set forth in claim 1, further comprising:

driving force generating means for generating driving force for rotating said photoreceptor;

driving force transmitting means for transmitting the driving force; and driving means, provided on unit a side of, for rotating said photoreceptor in accordance with the transmitted force.

8. An image forming apparatus as set forth in claim 1, further comprising:

cleaner means, provided in said unit so as to be on the inner surface side of said photoreceptor, for transporting contaminated materials adhered to the inner surface of said photoreceptor in a shaft direction of said photoreceptor.

9. The image forming apparatus as set forth in claim wherein said cleaner means includes:

at least one blade holder;

at least one blade, provided on said blade holder, uniformly coming into contact with the inner surface of said photorecptor so as to give the inner surface a predetermined pressure.

10. The image forming apparatus as set forth in claim 9, wherein said cleaner means is disposed so that a cleaner area where said blade comes into contact with the inner surface of said photoreceptor does not overlap with each other (1) a transfer area where toners are transferred to copy material and (2) an exposure area where exposure is carried out with respect to said photoreceptor.

11. The image forming apparatus as set forth in claim 10, wherein said cleaner means is located so that an intersection between (1) a plumb line which is extended from the lowest point of the cleaner area in a rotation direction of said photorecptor and (2) the inner surface of said photoreceptor is positioned farther in the rotation direction of said photorecptor than the lowest point in the transfer area, thereby avoiding that the contaminated materials removed from the cleaner area fall down to the transfer area.

12. The image forming apparatus as set forth in claim 9, wherein neighboring blades overlap one another in the shaft direction of said photoreceptor.

13. The image forming apparatus as set forth in claim 8, wherein said cleaner means includes:

at least one blade holder;

a plurality of blades, provided on said blade holder with a predetermined interval, uniformly coming into contact with the inner surface of said photoreceptor so as to give the inner surface a predetermined pressure, said each blade having a predetermined angle with respect to a shaft direction of said photoreceptor, wherein said blade has a curvature of substantially coincident with that of said photoreceptor.

14. The image forming apparatus as set forth in claim 8, wherein said cleaner means includes a brush.

15. The image forming apparatus as set forth in claim 8, wherein said cleaner means includes:

a blade provided parallel to the shaft direction of said photoreceptor;

a receiving member for receiving the contaminated materials which have been removed by said blade; and a transporting member for transporting in the shaft direction of said photoreceptor the contaminated materials which have been received by said receiving member.

16. An image forming apparatus as set forth in claim 8, further comprising:

abolition means, attachably and detachably provided with respect to said unit, for collecting the contaminated materials, which have been transported through a discharge hole, through an abolition hole, the discharge hole being provided on the lowest Side of a direction in which the contaminated materials are transported, wherein the discharge hole and abolition hole are opened to communicate with each other during attaching said abolition means to said unit, while the discharge hole and abolition hole are covered during taking said abolition means out of said unit.

17. An image forming apparatus comprising:

an image forming apparatus main body;

a photoreceptor, rotatably provided in a unit, which is made of a transparent material and has a cylindrical shape;

exposure means, provided on the inner surface side of said photoreceptor, for exposing said photoreceptor, and moving means, movably provided with respect to a shaft direction of said photoreceptor during attaching and detaching of said unit with respect to said image forming apparatus main body, for supporting said unit, wherein said exposure means becomes located on an inner surface side of said photoreceptor after said unit is attached to said image forming apparatus main body by said moving means.

18. An image forming apparatus as set forth in claim 17, further comprising:

positioning pins provided on a side of said image forming apparatus; and positioning holes provided in said moving means so as correspond to said respective positioning pins, wherein said positioning pins pass through said respective positioning holes during attachment and detachment of said unit with respect to said image forming apparatus main body, thereby causing positioning of said unit to be carried out.

19. The image forming apparatus as set forth in claim 18, wherein said moving means includes:

a guiding member, supporting said exposure means on a side reverse to said side of said image forming apparatus, for guiding and moving said unit so that respective central lines of said photoreceptor and of said exposure means slightly deviate with respect to each other.

20. An image forming apparatus as set forth in claim 17, further comprising:

cleaner means, provided in said unit so as to be on the inner surface side of said photoreceptor, for transporting contaminated materials adhered to the inner surface of said photoreceptor in a shaft direction of said photoreceptor.

21. The image forming apparatus as set forth in claim 20, wherein said cleaner means includes:

at least one blade holder;

at least one blade, provided on said blade holder, uniformly coming into contact with the inner surface of said photoreceptor so as to give the inner surface a predetermined pressure.

22. The image forming apparatus as set forth in claim 21, wherein said cleaner means is disposed so that a cleaner area where said blade comes into contact with the inner surface of said photoreceptor does not overlap with each other (1) a transfer area where toners are transferred to copy material and (2) an exposure area where exposure is carried out with respect to said photoreceptor.

23. The image forming apparatus as set forth in claim 22, wherein said cleaner means is located so that an intersection between (1) a plumb line which is extended from the lowest point of the cleaner area in a rotation direction of said photoreceptor and (2) the inner surface of said photoreceptor is positioned farther in the rotation direction of said photorecptor than the lowest point in the transfer area, thereby avoiding that the contaminated materials removed from the cleaner area fall down to the transfer area.

24. The image forming apparatus as set forth in claim 21, wherein neighboring blades overlap one another in the shaft direction of said photoreceptor.

25. The image forming apparatus as set forth in claim 20, wherein said cleaner means includes:

at least one blade holder;

a plurality of blades, provided on said blade holder with a predetermined interval, uniformly coming into contact with the inner surface of said photoreceptor so as to give the inner surface a predetermined pressure, said each blade having a predetermined angle with respect to a shaft direction of said photoreceptor, wherein said blade has a curvature of substantially coincident with that of said photoreceptor.

26. The image forming apparatus as set forth in claim 20, wherein said cleaner means includes a brush.

27. The image forming apparatus as set forth in claim 20, wherein said cleaner means includes:

a blade provided parallel to the shaft direction of said photoreceptor;

a receiving member for receiving the contaminated materials which have been removed by said blade; and a transporting member for transporting in the shaft direction of said photoreceptor the contaminated materials which have been received by said receiving member.

28. An image forming apparatus as set forth in claim 20, further comprising:

abolition means, attachably and detachably provided with respect to said unit, for collecting the contaminated materials, which have been transported through a discharge hole, through an abolition hole, the discharge hole being provided on the lowest side of a direction in which the contaminated materials are transported, wherein the discharge hole and abolition hole are opened to communicate with each other during attaching said abolition means to said unit, while the discharge hole and abolition hole are covered during taking said abolition means out of said unit.

* * * * *